US008274455B2

(12) United States Patent
Kwak et al.

(10) Patent No.: US 8,274,455 B2
(45) **Date of Patent: *Sep. 25, 2012**

(54) PIXEL DRIVING CIRCUIT FOR A DISPLAY DEVICE AND A DRIVING METHOD THEREOF

(75) Inventors: Won-Kyu Kwak, Yongin (KR); Kwan-Hee Lee, Yongin (KR); Keum-Nam Kim, Yongin (KR)

(73) Assignee: Samsung Display Co., Ltd., Yongin (KR)

( * ) Notice: Subject to any disclaimer, the term of this patent is extended or adjusted under 35 U.S.C. 154(b) by 115 days.

This patent is subject to a terminal disclaimer.

(21) Appl. No.: 12/873,240

(22) Filed: Aug. 31, 2010

(65) Prior Publication Data

US 2010/0328367 A1 Dec. 30, 2010

Related U.S. Application Data

(62) Division of application No. 10/963,881, filed on Oct. 12, 2004, now Pat. No. 7,903,052.

(30) Foreign Application Priority Data

Nov. 14, 2003 (KR) ..... 2003-80727

(51) Int. Cl.
*G09G 3/30* (2006.01)

(52) U.S. Cl. ..... 345/76; 345/82; 315/169.1

(58) Field of Classification Search ..... 345/60–68, 345/76–83; 315/169.1–169.4
See application file for complete search history.

(56) References Cited

U.S. PATENT DOCUMENTS

| | | | | |
|---|---|---|---|---|
| 5,748,160 | A | 5/1998 | Shieh et al. | |
| 6,421,033 | B1 | 7/2002 | Williams et al. | |
| 6,618,031 | B1 | 9/2003 | Bohn, Jr. et al. | |
| 6,858,991 | B2 | 2/2005 | Miyazawa | |
| 7,903,052 | B2 * | 3/2011 | Kwak et al. | 345/76 |

(Continued)

FOREIGN PATENT DOCUMENTS

CN 1133463 A 10/1996

(Continued)

OTHER PUBLICATIONS

European Search Report dated Sep. 17, 2010, for corresponding European Patent application 04090392.4, noting listed reference in this IDS.

(Continued)

*Primary Examiner* — Srilakshmi K Kumar
(74) *Attorney, Agent, or Firm* — Christie, Parker & Hale, LLP

(57) ABSTRACT

A pixel driving circuit for a display device in which a plurality of gate lines and data lines are arranged. The pixel circuit is disposed at an intersection between the gate lines and data lines, and includes at least two light emitting elements for emitting certain colors within a certain section; an active device commonly connected to the at least two light emitting elements to drive the at least two light emitting elements; and an power source control part connected to the active device to transmit driving control signals for the at least two light emitting elements to the active device. The active device sequentially drives the at least two light emitting elements in the certain section per a certain period of time in response to the power source signals transmitted through the power source control part, and the at least two light emitting elements are sequentially emitted.

29 Claims, 16 Drawing Sheets

U.S. PATENT DOCUMENTS

2003/0107560 A1 6/2003 Yumoto et al.

FOREIGN PATENT DOCUMENTS

| | | | |
|---|---|---|---|
| CN | 1224511 | A | 7/1999 |
| CN | 1312482 | A | 9/2001 |
| EP | 1 291 841 | A2 | 3/2003 |
| EP | 0 762 374 | B1 | 4/2007 |
| JP | 02-118593 | | 5/1990 |
| JP | 9-138659 | | 5/1997 |
| JP | 2001-0105273 | | 11/2001 |
| JP | 2002-82652 | | 3/2002 |
| JP | 2002-0060604 | | 7/2002 |
| JP | 2002-215093 | | 7/2002 |
| JP | 2002-221917 | | 8/2002 |
| JP | 2003-50564 | | 2/2003 |
| JP | 2003-131619 | | 5/2003 |
| JP | 2003-248461 | | 9/2003 |
| JP | 2003-280614 | | 10/2003 |

OTHER PUBLICATIONS

Chinese Patent Registration Gazette dated Jul. 22, 2009, for corresponding Chinese application 200410092220.8, noting listed references in this IDS, as well as references previously filed in an IDS dated Nov. 6, 2007 and May 22, 2008 for parent U.S. Appl. 10/963,881, filed Oct. 12, 2004.

European Search Report dated Jun. 24, 2008, for corresponding European application 04090392.4, indicating relevance of listed references.

Patent Abstracts of Japan, Publication No. 2003-131619, dated May 9, 2003, in the name of Atsushi Hanari.

Chinese Office action dated Feb. 29, 2008, for corresponding China application 200410092220.8, with English translation indicating relevance of listed references.

Korean Patent Abstracts Publication No. 1020010105273 A, dated Nov. 28, 2001, in the name of Yoshifumi Tanada.

Korean Patent Abstracts Publication No. 1020020060604 A, dates Jul. 18, 2002, in the name of Takaji Numao.

Patent Abstracts of Japan, Publication No. 09-138659, dated May 27, 1997, in the name of Chan-Long Shieh et al.

Patent Abstracts of Japan, Publication No. 2002-082652, dated Mar. 22, 2002, in the name of Kazuyuki Shigeta.

Patent Abstracts of Japan, Publication No. 2002-215093, dated Jul. 31, 2002, in the name of Akira Yumoto et al.

Patent Abstracts of Japan, Publication No, 2002-221917, dated Aug. 9, 2002, in the name of Shin Asano et al.

Patent Abstracts of Japan, Publication No. 2003-050584, dated Feb. 21, 2003, in the name of Shin Asano.

Patent Abstracts of Japan, Publication No. 2003-280614, dated Oct. 2, 2003, in the name of Masahiro Sakai et al.

China Office action dated Aug. 17, 2007 for CN 200410092220.8, with English translation.

* cited by examiner

PIXEL DRIVING CIRCUIT FOR A DISPLAY DEVICE AND A DRIVING METHOD THEREOF

CROSS REFERENCE TO RELATED APPLICATIONS

This application is a division of U.S. patent application Ser. No. 10/963,881, filed Oct. 12, 2004, which claims priority to and the benefit of Korean Patent Application No. 2003-80727, filed on Nov. 14, 2003 in the Korean Intellectual Property Office, the entire contents of all of which are incorporated herein by reference.

BACKGROUND OF THE INVENTION

1. Field of the Invention

The present invention relates to a driving circuit for a light emitting element used in an image display unit, and more particularly to a pixel driving circuit for a display device in which opening ratio of the light emitting element is improved by using a common driving circuit for each pixel, thereby reducing a number of elements in a driving circuit for driving the light emitting element installed inside a panel of a display device.

2. Description of Related Art

An organic electroluminescent (EL) display device performs display by applying a current from a pixel electrode formed per pixel to an organic electroluminescent (EL) device. The organic EL display device can be classified into a passive matrix type display device or an active matrix type display device. The active matrix type display device includes a switching element installed at each pixel inside an organic EL panel 30 and carries out image display in response to a control voltage or current corresponding to image data of the pixel as illustrated in FIG. 1.

FIG. 1 is a block diagram illustrating a conventional active matrix type organic EL display device.

As illustrated in FIG. 1, an active matrix type organic EL display device includes a data driver 10 for outputting image data, a scan driver 20 for outputting selection signals, data lines D_R1, D_G1, D_B1, . . . D_Rn, D_Gn, D_Bn coupled to the data driver 10, and gate lines S1, S2, . . . Sm-1, Sm coupled to the scan driver 20. As shown in FIG. 1, an organic EL panel 30 includes a plurality of pixels 31 that are longitudinally and laterally arranged and coupled to corresponding ones of the data lines and the gate lines, respectively. Each pixel 31 is a combination of red, green and blue unit pixels, and is formed at a corresponding intersection between the gate lines and the data lines in the organic EL panel 30.

Therefore, if image data are received from the data driver 10 and scan signals are received from the scan driver 20, each pixel driving circuit transmits relevant driving signals to a corresponding light emitting element according to the received signals so that each pixel 31 displays respective colors according to the combination of red, green and blue. That is, a conventional pixel includes a driving circuit per each pixel so that the driving circuit is connected to the gate lines and data lines, respectively. Therefore, the pixel displays one pixel data by individually driving each of the unit pixels in response to the received scan signals and data signals.

FIG. 2 is a schematic diagram illustrating a conventional pixel driving circuit.

As illustrated in FIG. 2, the conventional pixel is a combination of red, green and blue unit pixels formed at an intersection between data lines and gate lines, and each unit pixel includes a driving circuit for driving a corresponding one of the EL devices. In other words, each of the driving circuits for driving one of the unit pixels on the same row is connected to a different one of the data lines, but to the same gate line. By way of example, driving circuits located on the same row are connected to only one gate line S1, but are connected to data lines D_R1, D_G1, D_B1, D_R2, D_G2, D_B2 . . . D_Rn, D_Gn and D_Bn, respectively.

A gate of a first thin film transistor M1 is connected to a gate line Scan, and a source of the first thin film transistor M1 is connected to a data line D_R1. Furthermore, a first capacitor C1 is connected between a drain of the first thin film transistor M1 and a first power supply voltage Vdd. A gate of a second thin film transistor M2 is connected between the first capacitor C1 and the drain of the first thin film transistor M1. The first power supply voltage Vdd is connected to a source of the second thin film transistor M2, and an anode of a red EL device R is connected to a drain of the second thin film transistor M2. In addition, a cathode of the red EL device R is connected to a second power supply voltage Vss.

The second power supply voltage Vss is also connected to a cathode of a green EL device G, and a drain of a fourth thin film transistor M4 is connected to an anode of the green EL device G. The first power supply voltage Vdd is connected to a source of the fourth thin film transistor M4, and a drain of the third thin film transistor M3 is connected to a gate of the fourth thin film transistor M4. Further, the gate line Scan is connected to a gate of the third thin film transistor M3, and a data line D_G1 is connected to a source of the third thin film transistor M3. A second capacitor C2 is connected between the gate of the fourth thin film transistor M4 and the first power supply voltage Vdd.

Further, a drain of a sixth thin film transistor M6 is connected to an anode of a blue EL device B, and the second power supply voltage Vss is connected to a cathode of the blue EL device B. The first power supply voltage Vdd is connected to a source of the sixth thin film transistor M6, and a drain of the fifth thin film transistor M5 is connected to a gate of the sixth thin film transistor M6. A third capacitor C3 is connected between the gate of the sixth thin film transistor M6 and the first power supply voltage Vdd. Further, the gate line Scan is connected to a gate of the fifth thin film transistor M5, and a data line D_B1 is connected to a source of the fifth thin film transistor M5. The cathode of the said red, green and blue EL devices are connected to the second power supply voltage Vss.

The first, third and fifth thin film transistors M1, M3 and M5 are turned on in response to a scan signal applied on the gate line Scan through a sequential selection of the gate lines by the scan driver 20. Therefore, image signals applied to the respective data lines D_R1, D_G1, D_B1 by the data driver 10 are inputted into the source side of the thin film transistors M1, M3, M5 and stored in the capacitors C1, C2, C3, respectively. Therefore, second, fourth and sixth thin film transistors M2, M4, M6 are turned on to transfer the first power supply voltage Vdd transferred from the source side and a current corresponding to a square of the difference between the data voltage and the threshold voltage to the respective red, green and blue EL devices so that the red, green and blue EL devices are emitted according to the magnitude of the applied current.

Referring to a driving waveform diagram of FIG. 3, the operation of a conventional organic EL display device described above is further described as follows.

In reference to FIGS. 1 and 3, first, if a scan signal S1 is applied on a first gate line S1, the first gate line S1 is driven, and pixels PR11-PB1*n* connected to the first gate line S1 are driven.

That is, the switching thin film transistors M1, M3, M5, respectively, of is red, green and blue unit pixels PR11-PR1*n*, PG11-PG1*n*, PB11-PB1*n* connected to the first gate line S1 are driven by the scan signal S1 applied on the first gate line S1. Red, green and blue data signals D1(D_R1-D_Rn), D1(D_G1-D_Gn), D1(D_B1-D_Bn) are simultaneously applied on the gates of the driving thin film transistors M2, M4, M6 of red, green and blue unit pixels, respectively, through the red, green and blue data lines D_R1-D_Rn, D_G1-D_Gn, D_B1-D_Bn that constitute first to $n^{th}$ data lines D1, . . . Dn in response to the driving of the switching thin film transistors M1, M3, M5.

The driving thin film transistors M2, M4, M6 of red, green and blue unit pixels supply driving current corresponding to red, green and blue data signals D1 (D_R1-D_Rn), D1 (D_G1-D_Gn), D1 (D_B1-D_Bn), respectively, that are applied through the red, green and blue data lines D_R1-D_Rn, D_G1-D_Gn, D_B1-D_Bn to the red, green and blue EL devices. Therefore, the EL devices including pixels PR11-PB1*n* connected to the first gate line S1 are simultaneously driven when the scan signals are applied to the first gate line S1.

In a similar manner, if scan signals for driving a second gate line are applied on a second scan line S2, data signals D2(D_R1-D_Rn), D2(D_G1-D_Gn), D2(D_B1-D_Bn) are applied to pixels PR21-PR2*n*, PG21-PG2*n*, PB21-PB2*n* connected to the second gate line S2 through the red, green and blue data lines D_R1-D_Rn, D_G1-D_Gn, D_B1-D_Bn.

The EL devices including the pixels PR21-PR2*n*, PG21-PG2*n*, PB21-PB2*n* connected to the second gate line S2 are simultaneously driven by driving current corresponding to the data signals D2(D_R1-D_Rn), D2(D_G1-D_Gn), D2(D_B1 -_Bn).

The EL devices including pixels PRm1-PBmn connected to the $m^{th}$ gate line Sm are simultaneously driven in response to red, green and blue data signals Dm(D_R1-D_Rn), Dm(D_G1-D_Gn), Dm(D_B1-D_Bn) applied on the red, green and blue data lines D_R1-D_Rn, D_G1-D_Gn, D_B1-D_Bn when a scan signal Sm is applied to the $m^{th}$ gate line Sm by repeating the foregoing operations.

Therefore, if the scan signals are sequentially applied on the gate lines S1 through Sm, the pixels (PR11-PB1*n*)-(PRm1-PBmn) connected to the respective gate lines S1-Sm display an image by being driven sequentially during one frame.

However, in an organic EL display device having the structure described above, each pixel includes red, green and blue unit pixels and driving elements (i.e., switching thin film transistor, driving thin film transistor and capacitor) for driving red, green and blue EL devices, for the red, green and blue unit pixels, respectively, are duplicated. Further, data lines and common power supply lines for supplying data signals and the power supply voltage Vdd to each driving element are also duplicated.

Therefore, three data lines and three power supply lines are arranged per pixel, and six transistors (i.e., three switching thin film transistors and three driving thin film transistors) and three capacitors are required for each pixel. Therefore, in the conventional Organic EL device, the circuit structure is complicated as a plurality of wirings and elements are used for each pixel, and an opening ratio of the light emitting elements is limited. Further, the yield also is decreases accordingly during the manufacturing process.

Further, in the conventional Organic EL device, the area of each pixel is reduced as the display device is gradually being made to have a higher precision, and not only is it difficult to arrange many elements on one pixel, but also the opening ratio is reduced accordingly.

SUMMARY OF THE INVENTION

Therefore, in order to solve the foregoing problems of the conventional organic EL device, in an exemplary embodiment of the present invention is provided a pixel driving circuit for driving light emitting elements inside a pixel of a display device in which the opening ratio and yield are improved, and panel space is more efficiently used by commonly connecting the switching transistor and the driving transistor to EL devices, thereby reducing wirings and elements inside organic EL panel. A driving method for the pixel driving circuit is also provided.

In order to achieve the foregoing, an exemplary embodiment of the present invention provides a pixel driving circuit for a display device in which a plurality of gate lines and data lines are arranged, and a pixel driving circuit is disposed at an intersection between the gate lines and the data lines. The pixel driving circuit includes at least two light emitting elements for emitting certain colors within a certain section; an active device commonly connected to the at least two light emitting elements to drive the at least two light emitting elements; and a power source control part connected to the active device to transmit power source signals for the at least two light emitting elements to the active device, wherein the active device sequentially controls emission of the at least two light emitting elements in the certain section per a certain period of time in response to the power source signals transmitted through the power source control part, and the at least two light emitting elements are sequentially emitted per the certain period of time to realize the certain colors in the certain section.

In another exemplary embodiment, the power source control part is a first power source control part for sequentially transmitting a first power source voltage to the active device per the certain period of time in the certain section and the active device sequentially outputs driving signals for the at least two light emitting elements so that the light emitting elements are sequentially driven time-divisionally.

In still another exemplary embodiment, the certain section is one frame, the one frame is divided into at least two sub frames, the certain period of time is one said sub frame, and the at least two light emitting elements are sequentially driven per sub frame inside the one frame.

In a further exemplary embodiment, the certain section is one frame, the one frame is divided into at least three sub frames, the certain period of time is one said sub frame, the at least two light emitting elements are sequentially driven per sub frame inside the one frame, and one said light emitting element is driven again or the at least two light emitting elements are substantially simultaneously driven in remaining at least one sub frame so that brightness is controlled. The remaining at least one sub frame may be arbitrarily selected from the at least three sub frames.

In a still further exemplary embodiment, the active device controls a light emitting time of the at least two light emitting elements according to the power source signals transmitted from the power source control part so as to control white balance.

The at least two light emitting elements may include at least one of a red EL device, a green EL device, a blue EL device and a white EL device.

The at least two light emitting elements may include a first electrode connected to the active device, and a second electrode commonly connected to a reference power source.

The active device may include at least one switching element for driving the at least two light emitting elements.

The at least one switching element may include a thin film transistor, a thin film diode, a diode or a triodic rectifier switch (TRS).

In a still further exemplary embodiment, the active device includes a switching device for transmitting data signals received through data lines in response to scan signals transmitted through one of the gate lines; and a driving device for transmitting driving signals to the at least two light emitting elements in response to the data signals.

In another exemplary embodiment of the present invention is provided a pixel driving circuit for a display device in which a plurality of gate lines and data lines are arranged. The pixel driving circuit is disposed at an intersection between the gate lines and the data lines. The pixel driving circuit includes at least two light emitting elements for emitting certain colors within a certain section; a switching device for transmitting data signals received through one of the data lines in response to scan signals received through one of the gate lines; a driving device connected to the at least two light emitting elements to sequentially transmit driving signals to the at least two light emitting elements in response to the data signals transmitted by the switching device; and a power source control part connected to the at least two light emitting elements to sequentially transmit power source signals, wherein the at least two light emitting elements are sequentially emitted per a certain period of time in the certain section in response to the power source signals to realize the certain colors in the certain section.

In another exemplary embodiment, the power source control part is a second power source part for sequentially transmitting a second power source voltage to the at least two light emitting elements and as the second power source voltage is sequentially transmitted to the at least two light emitting elements per the certain period of time in the certain section, the at least two light emitting elements are sequentially driven time-divisionally.

In still another exemplary embodiment, the certain section is one frame, the one frame is divided into at least two sub frames, the certain period of time is one said sub frame, and the at least two light emitting elements are sequentially driven per sub frame inside the one frame.

In a further exemplary embodiment, the certain section is one frame, the one frame is divided into at least three sub frames, the certain period of time is one said sub frame, the at least two light emitting elements are sequentially driven per sub frame inside the one frame, and one said light emitting element is driven again or the at least two light emitting elements are substantially simultaneously driven in remaining at least one sub frame so that brightness is controlled. The remaining at least one sub frame may be arbitrarily selected from of the at least three sub frames.

The the power source control part may control a light emitting time of the at least two light emitting elements so that white balance is controlled.

The at least two light emitting elements may include at least one of a red EL device, a green EL device, a blue EL device and a white EL device.

The at least two light emitting elements may include a first electrode commonly connected to the driving device, and a second electrode connected to the power source control part.

The switching device and the driving device may include at least one of switching element, which is a thin film transistor, a thin film diode, a diode or a triodic rectifier switch (TRS).

In yet another exemplary embodiment of the present invention is provided a pixel driving circuit for a display device including red, green and blue EL devices; a switching device for sequentially transmitting red, green and blue data signals; and a plurality of driving devices connected to the switching device to drive the red, green and blue EL devices in response to the red, green and blue data signals sequentially received through the switching device, wherein the red, green and blue EL devices are respectively connected to the plurality of driving devices, and the driving devices sequentially drive the red, green and is blue EL devices in response to power source signals and the data signals.

In yet another exemplary embodiment, the power source signals include a power source voltage, and emission of the red, green and blue EL devices is controlled by sequentially outputting the power source voltage to the plurality of driving devices.

In still another exemplary embodiment, the red, green and blue EL devices are sequentially driven in response to corresponding the power source signals per each sub frame inside one frame including at least three sub frames.

In a further exemplary embodiment, the red, green and blue EL devices are sequentially driven in three said sub frames, the red, green and blue EL devices are independently driven in a remaining sub frame, or at least two EL devices are driven in the remaining sub frame.

In a still further exemplary embodiment, the red, green and blue EL devices control white balance by controlling a light emitting time using the power source signals.

In yet another exemplary embodiment of the present invention is provided a pixel driving circuit for a display device including red, green and blue EL devices; a switching transistor for sequentially transmitting red, green and blue data signals; and a plurality of driving devices connected to the switching transistor to drive the red, green and blue EL devices in response to the red, green and blue data signals sequentially received through the switching transistor, wherein each said first electrode is connected to a corresponding one of the plurality of driving devices, and each said second electrode is connected to a second power source control part, such that the red, green and blue EL devices are sequentially emitted in response to driving signals transmitted by the driving devices in response to second power source signals transmitted from the second power source control part.

In yet another exemplary embodiment, each said driving device includes a driving transistor connected to a second electrode of the switching transistor; and a capacitor connected between a gate of the driving transistor and the power source.

In still another exemplary embodiment, the pixel driving circuit further includes a threshold voltage compensation device for compensating deviation of a threshold voltage.

In a further exemplary embodiment, the second power source signals include a second power source voltage for controlling emission of the red, green and blue EL devices by sequentially outputting the second power source voltage to the red, green and blue EL devices.

In a still further exemplary embodiment, the red, green and blue EL devices are sequentially driven in response to the second power source signals per each sub frame inside the one frame including at least three sub frames.

In a yet further exemplary embodiment, the red, green and blue EL devices are sequentially driven in three sub frames, the red, green and blue EL devices are independently driven in a remaining sub frame, or at least two said EL devices are driven in the remaining sub frame.

In still another exemplary embodiment, the red, green and blue EL devices control white balance by controlling a light emitting time using corresponding the second power source signals in the respective sub frames.

In yet another exemplary embodiment of the present invention is provided a pixel driving circuit for a display device including red, green and blue EL devices, each having a first electrode and a second electrode; a switching transistor for sequentially transmitting red, green and blue data signals; a driving transistor connected to the switching transistor to sequentially drive the red, green and blue EL devices in response to the red, green and blue data signals; and storage means for storing the red, green and blue data signals, wherein wherein the first electrodes of the EL devices are commonly connected to the driving transistor, and each said second electrode is connected to a second power source control part, such that the red, green and blue EL devices are sequentially emitted in response to the driving signals transmitted through the driving transistors in response to second power source signals received from the second power source control part.

In yet another exemplary embodiment, the second power source signals include a second power source signals for controlling emission of the red, green and blue EL devices by sequentially outputting the second power source signals to the red, green and blue EL devices.

In still another exemplary embodiment, the pixel driving circuit further includes a threshold voltage compensation device for compensating deviation of a threshold voltage.

In a further exemplary embodiment, the red, green and blue EL devices are sequentially driven in response to the second power source signals per each sub frame inside one frame including at least three sub frames.

In a still further exemplary embodiment, the red, green and blue EL devices are sequentially driven in three sub frames, the red, green and blue EL devices are independently driven in a remaining sub frame, or at least two EL devices are driven in the remaining sub frame.

In a yet further exemplary embodiment, the red, green and blue EL devices control white balance by controlling a light emitting time using the second power source signals in the respective sub frames. In yet another exemplary embodiment of the present invention is provided an organic electroluminescent display device including a pixel driving circuit disposed at an intersection between gate lines and data lines, wherein the pixel driving circuit includes a first transistor having a gate connected to one of the gate lines, and a source connected to one of the data lines; a second transistor having a gate coupled to a drain of the first transistor, and a source connected to a red first power source line for supplying a red first power source voltage; a first capacitor connected between the gate of the second transistor, and the red first power source line; a third transistor having a gate coupled to the drain of the first transistor, and a source connected to a green first power source line for supplying a green first power source voltage; a second capacitor connected between the gate of the third transistor and the green first power source line; a fourth transistor having a gate coupled to the drain of the first transistor, and a source connected to a blue first power source line for supplying a blue first power source voltage; a third capacitor connected between the gate of the fourth transistor and the blue first power source line; and red, green and blue EL devices, each having a first electrode connected to a corresponding one of the drains of the second, third and fourth transistors, and a second electrode commonly connected to a reference voltage.

In yet another exemplary embodiment of the present invention is provided an organic electroluminescent display device including a pixel driving circuit disposed at an intersection between gate lines and data lines, wherein the pixel driving circuit includes a first transistor having a gate connected to one of the gate lines, and a source connected to one of the data lines; a second transistor having a gate coupled to a drain of the first transistor; a first capacitor connected between the gate and the source of the second transistor; a third transistor having a gate coupled to the drain of the first transistor; a second capacitor connected between the gate and the source of the third transistor; a fourth transistor having a gate coupled to the drain of the first transistor; a third capacitor connected between the gate and the source of the fourth transistor; a first power source line commonly connected to sources of the second, third and fourth transistors; red, green and blue EL devices, each having a first electrode connected to the drain of a corresponding one of the second, third and fourth transistors; a red second power source line connected to a second electrode of the red EL device; a green second power source line connected to a second electrode of the green EL device; and a blue second power source line connected to a second electrode of the blue EL device.

In yet another exemplary embodiment of the present invention is provided an organic electroluminescent display device including a pixel driving circuit disposed at an intersection between gate lines and data lines, wherein the pixel driving circuit includes a first transistor having a gate connected to one of the gate lines, and a source connected to one of the data lines; a second transistor having a gate connected to a drain of the first transistor, and a source connected to source line; a capacitor connected between the gate of the second transistor and the power source line; red, green and blue EL devices, each having a first electrode connected to the drain of the second transistor; a red second power source line connected to a second electrode of the red EL device; a green second power source line connected to a second electrode of the green EL device; and a blue second power source line connected to a second electrode of the blue EL device.

In yet another exemplary embodiment of the present invention is provided a driving method for a display device including a plurality of gate lines, a plurality of data lines, a plurality of power source lines, and a plurality of pixels, each pixel being connected to a corresponding one of the gate lines, a corresponding one of the data lines and a corresponding one of the power source lines, each pixel including at least red, green and blue light emitting elements. The method includes: sequentially supplying red, green and blue data to each said pixel through the corresponding one of the data lines per a certain period of time in a certain section so that the red, green and blue light emitting elements are sequentially driven time sharingly so as to realize a certain color in the certain section. In yet another exemplary embodiment of the present invention is provided a driving method for a display device including a plurality of gate lines, a plurality of data lines, a plurality of power source lines, and a plurality of pixels, each pixel being connected to a corresponding one of the gate lines, a corresponding one of the data lines and a corresponding one of the power source lines, each pixel including at least red, green and blue light emitting elements. The method includes: generating scan signals per a certain period of time in a certain section to the corresponding one of the gate lines; sequentially applying red, green and blue data to the corresponding one of the data lines whenever the scan signals are generated so that red, green and blue driving signals are generated on the corresponding one of the data lines; and sequentially driving the at least red, green and blue light emitting elements of the pixel connected to the corresponding one of the gate lines using first power source signals sequentially applied using a first power source control part, thereby realizing a certain color for the certain period of time in the certain section. The certain period of time includes three certain sections, and the red, green and blue light emitting elements are emitted one by one during the three certain sections so that the red, green and blue light emitting elements are sequentially emitted during the certain period of time.

BRIEF DESCRIPTION OF THE DRAWINGS

The above and other features of the present invention will become more apparent to those of ordinary skill in the art with the following description in detail of certain exemplary embodiments thereof with reference to the attached drawings in which.

DETAILED DESCRIPTION

Figure 1:
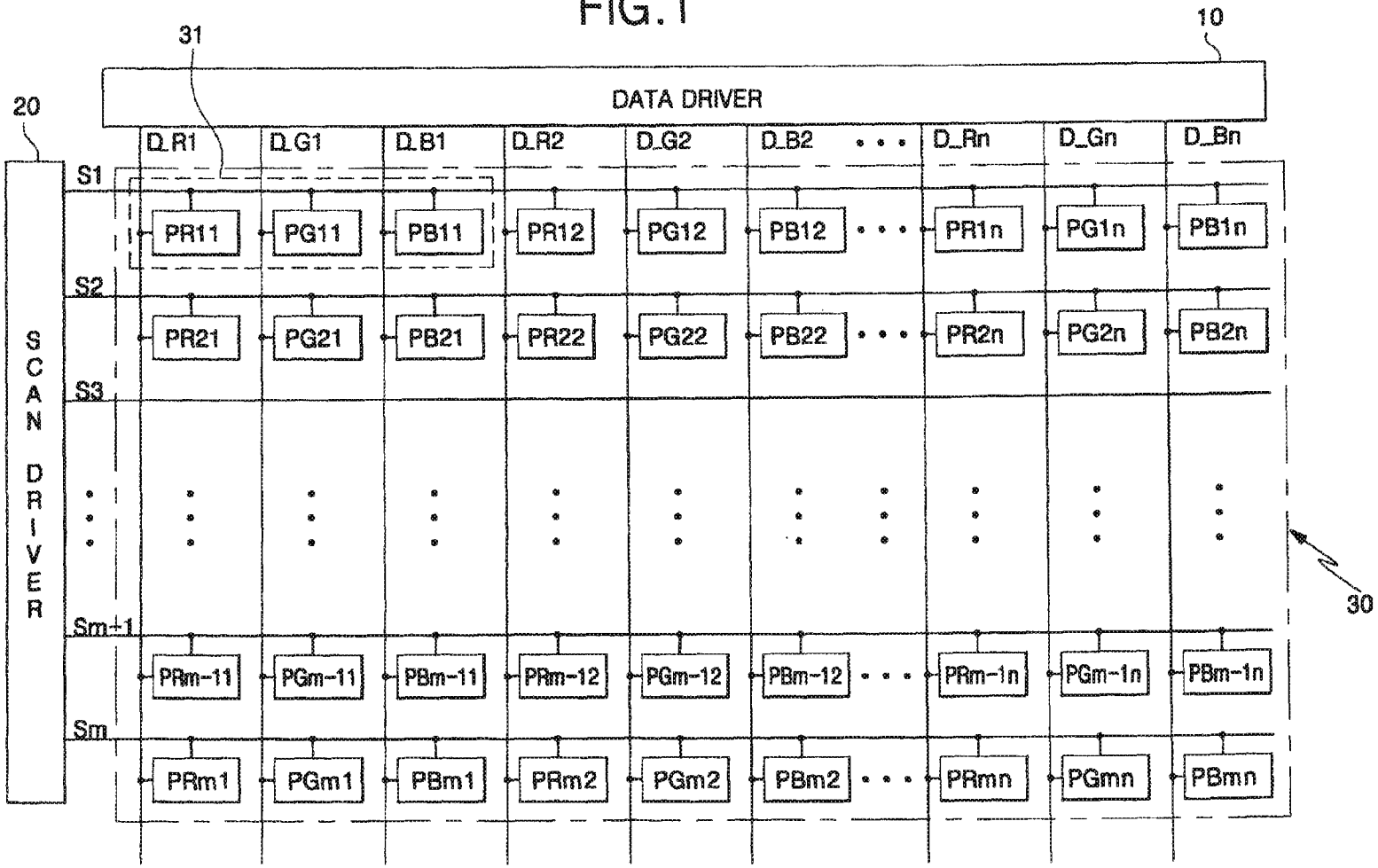
FIG. 1 is a block diagram showing a conventional display device.
Figure 2:
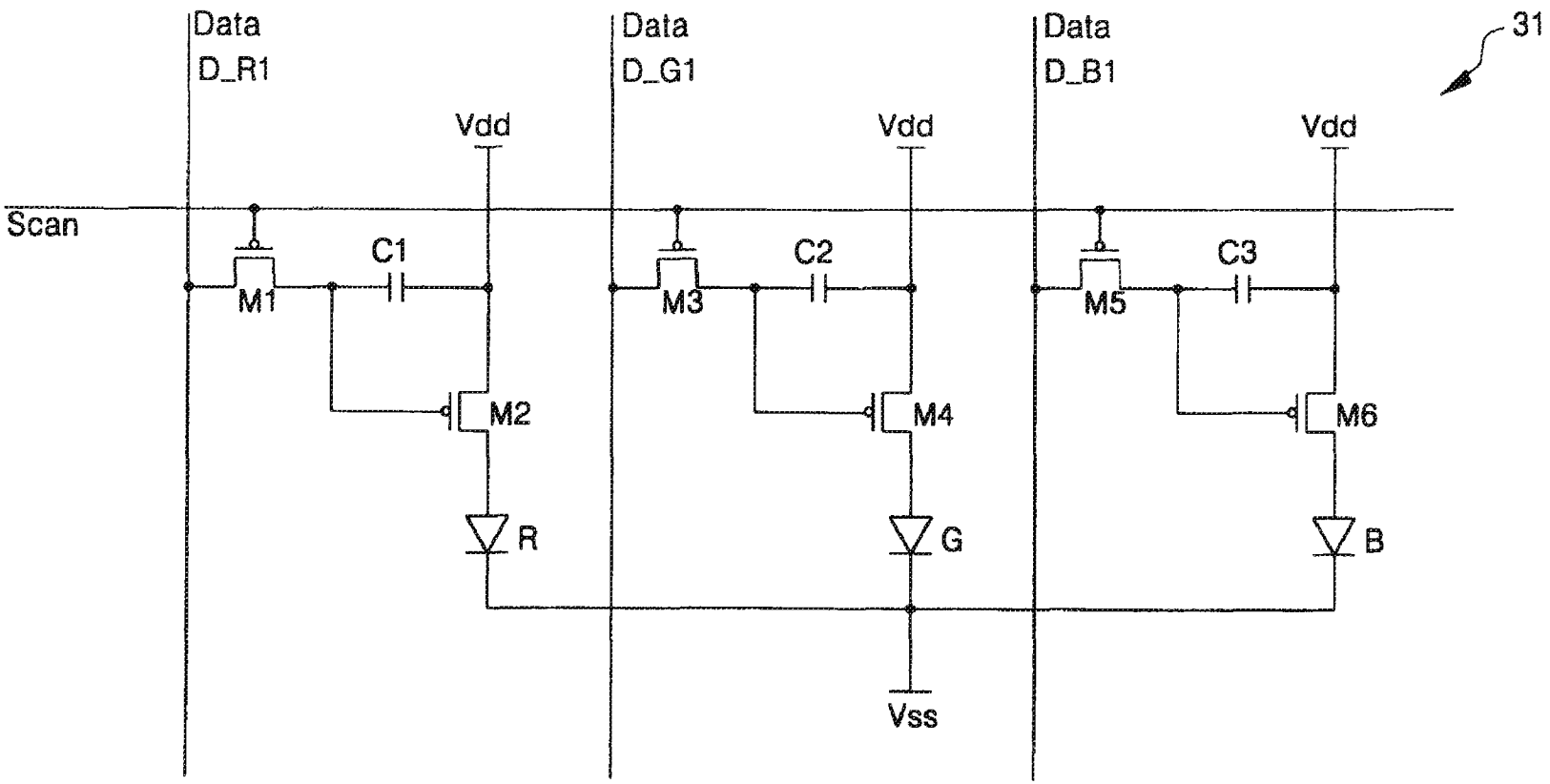
FIG. 2 is a pixel driving circuit for the conventional display device of FIG. 1.
Figure 3:
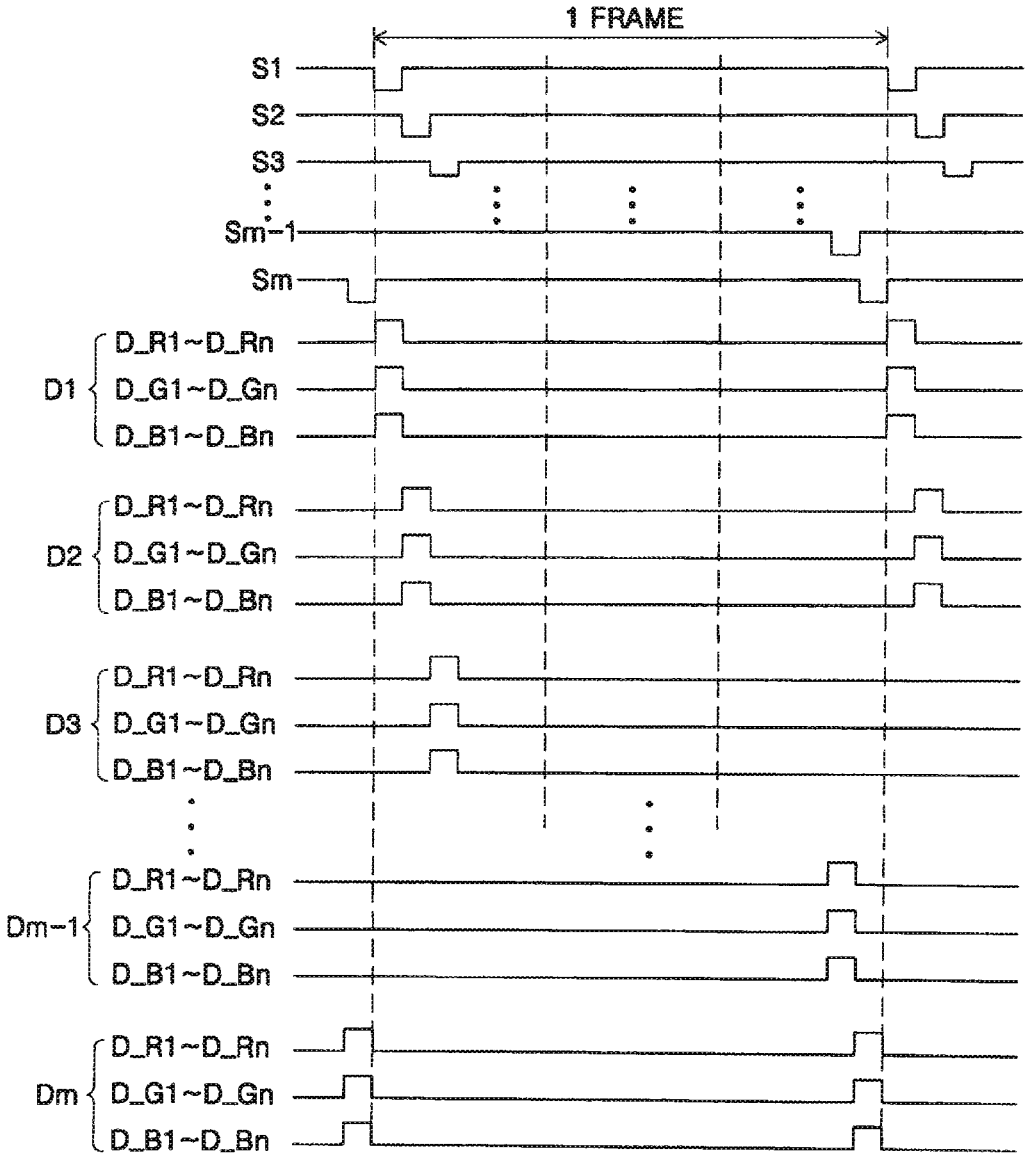
FIG. 3 is a timing diagram of waveforms for driving the pixel driving circuit of the conventional display device of FIG. 1.

The present invention will now be described in detail in connection with certain exemplary embodiments with reference to the accompanying drawings. In the drawings, like reference characters designate like components.

Figure 4:
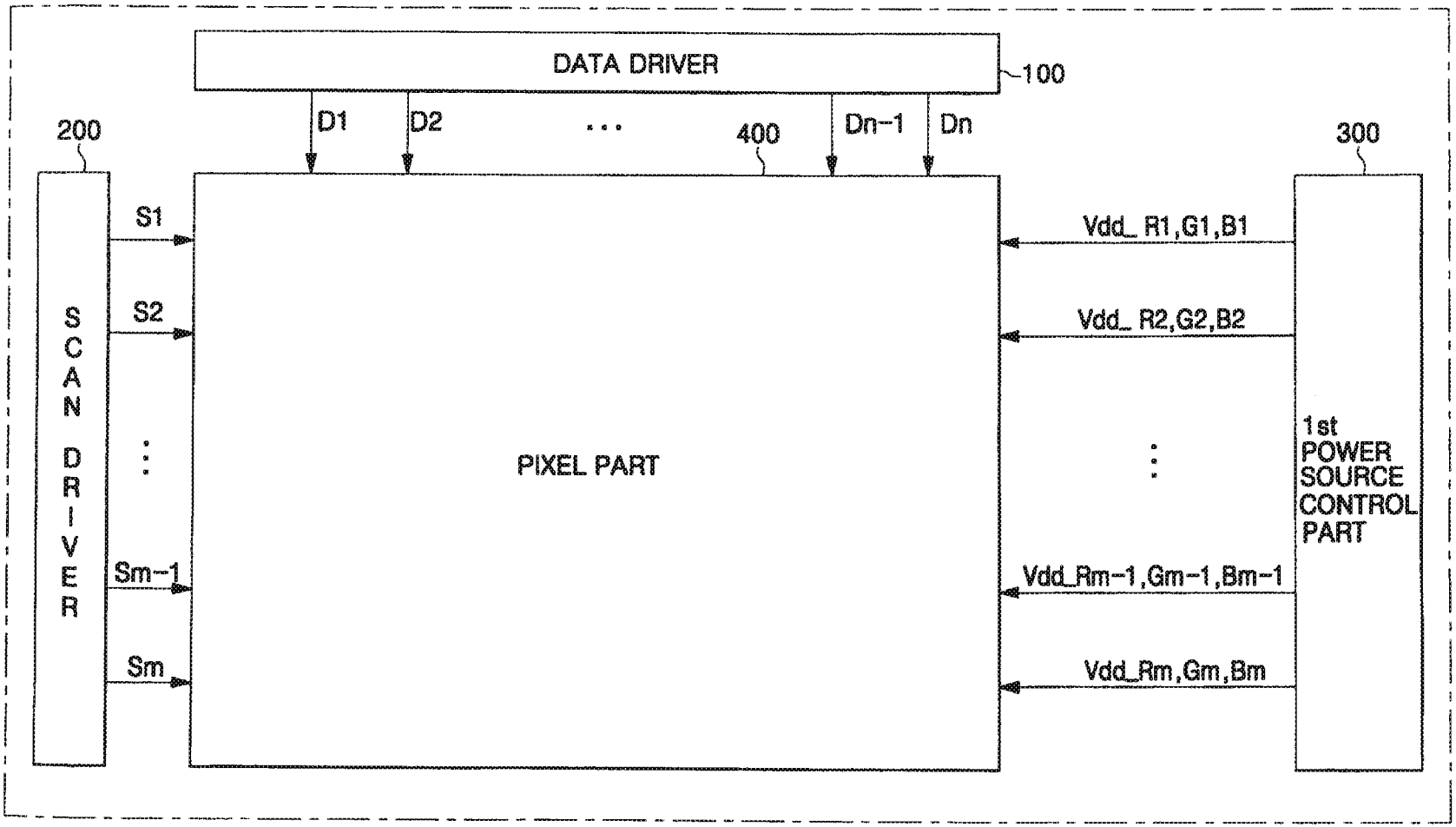
FIG. 4 is a block diagram of a display device according to a first exemplary embodiment of the present invention.

As illustrated in FIG. 4, a display device according to a first exemplary embodiment of the present invention includes a scan driver 200 for outputting scan signals, a data driver 100 for outputting data signals and a $1^{st}$ power source control part 300 for sequentially generating power source voltage. The scan driver 200 sequentially outputs scan signals S1-Sm to a pixel part 400 through gate lines connected to the pixel part 400. The data driver 100 sequentially outputs red, green and blue data signals D1-Dn to the pixel part 400 through data lines. The $1^{st}$ power source control part 300 controls emission of red, green and blue EL devices of the pixel part 400 by sequentially generating power source voltage (Vdd_R1, G1, B1)-(Vdd_Rm, Gm, Bm) whenever scan signals are applied during one frame. That is, in the first exemplary embodiment, an emission of the red, green and blue EL devices contained in each pixel is controlled by sequentially driving the first power source voltage connected to the red, green and blue EL devices, respectively.

Figure 5:
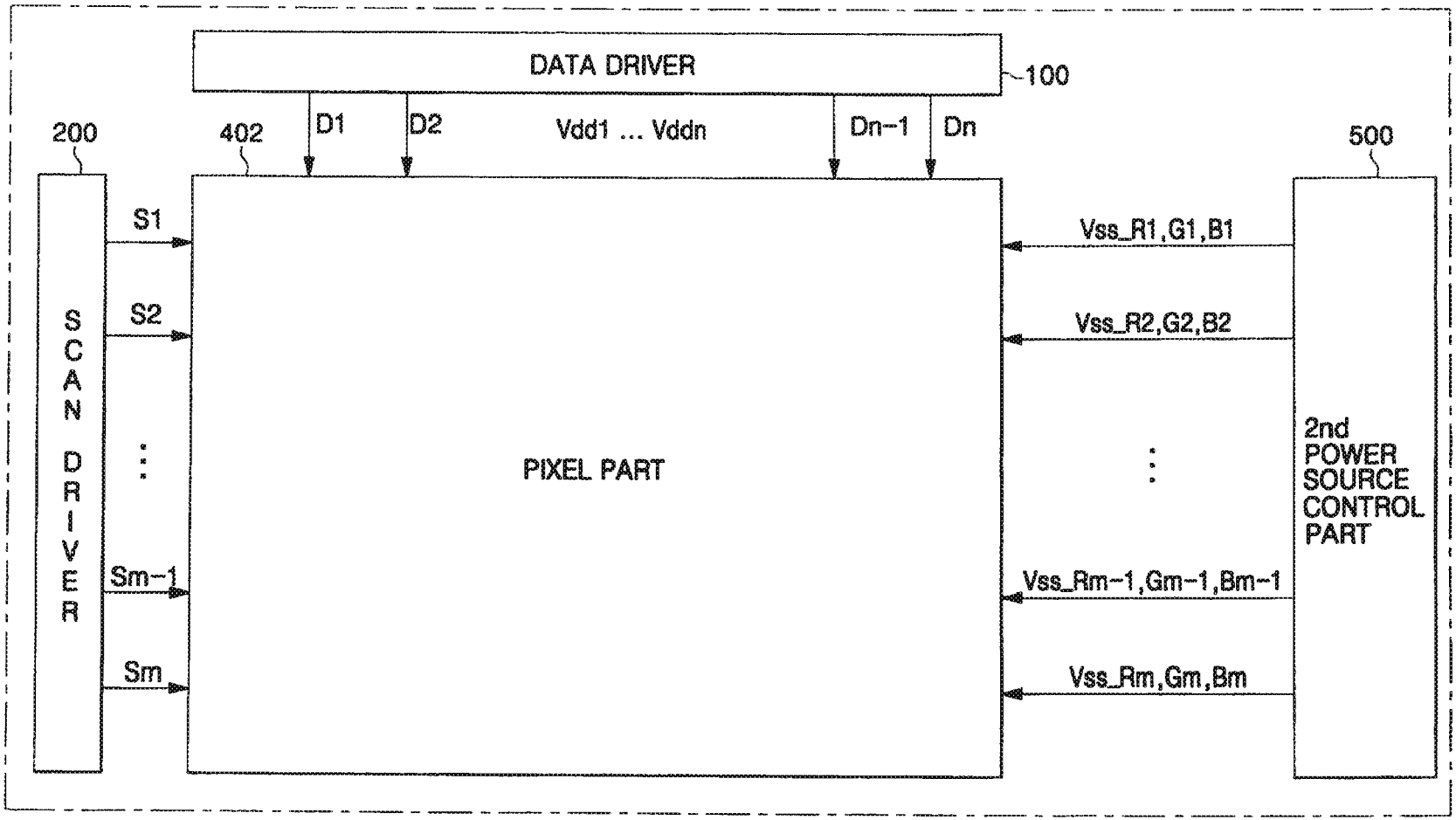
FIG. 5 is a block diagram of a display device according to a second exemplary embodiment of the present invention.

As illustrated in FIG. 5, a display device according to a second exemplary embodiment of the present invention includes a scan driver 200 for outputting scan signals, a data driver 100 for outputting data signals and a $2^{nd}$ power source control part 500 for sequentially generating a second power source voltage.

Figure 7:
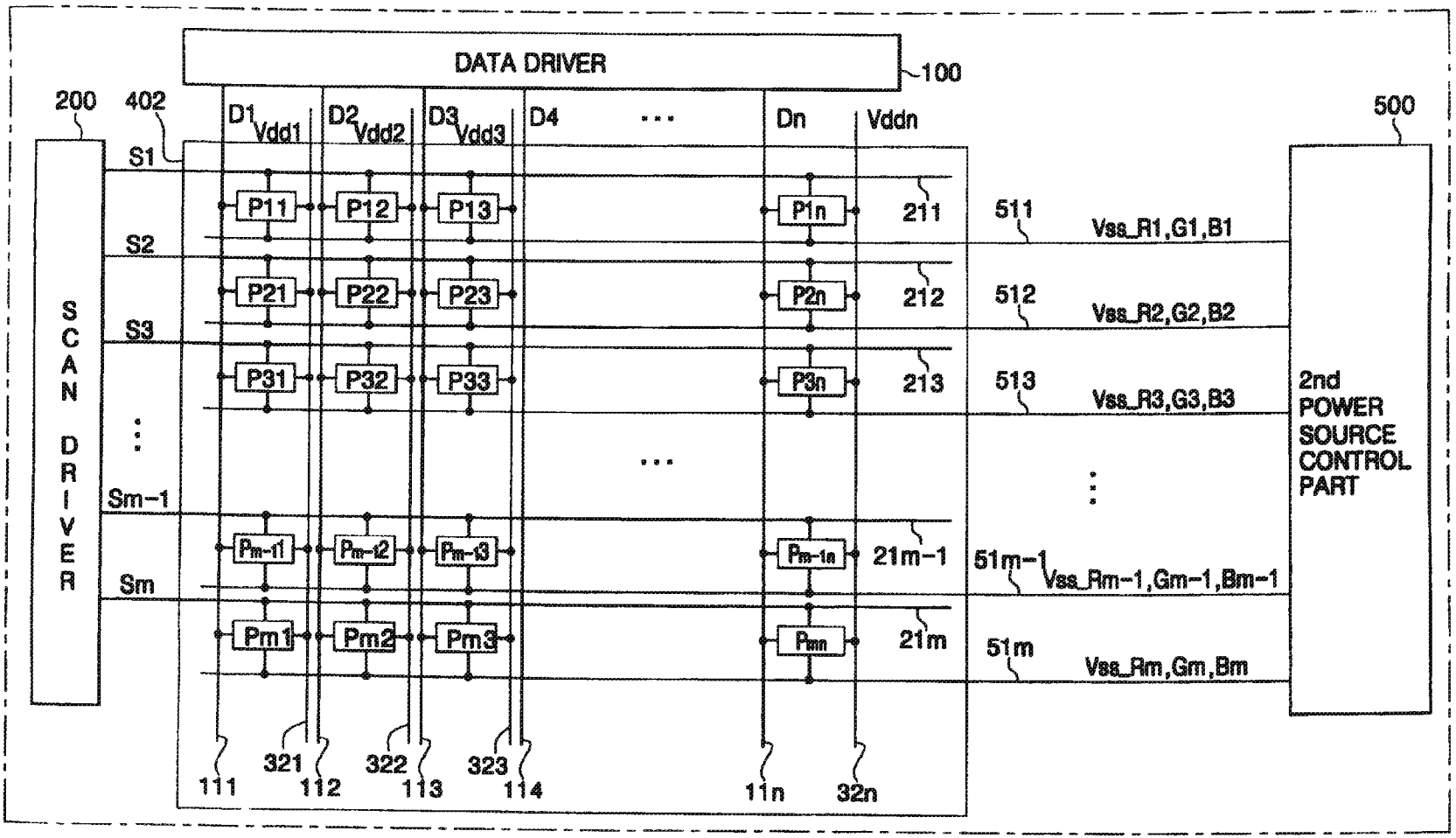
FIG. 7 is a block diagram of a pixel part in the display device of FIG. 5.

Also referring to FIG. 7, the scan driver 200 outputs scan signals S1-Sm to the pixel part 402 through gate lines (211-21*m*) connected to the pixel part 402. The data driver 100 sequentially outputs red, green and blue data signals D1-Dn to the pixel part 402 through data lines 111-11*n*. The $2^{nd}$ power source control part 500 controls emission of red, green and blue EL devices of the pixel part 500 by sequentially generating the second power source voltage (Vss_R1, G1, B1)-(Vss_Rm, Gm, Bm) whenever scan signals are applied. That is, in the second exemplary embodiment of the present invention, emission of the red, green and blue EL devices contained in each pixel is controlled by sequentially applying the second power source voltage to the red, green and blue EL devices.

Figure 6:
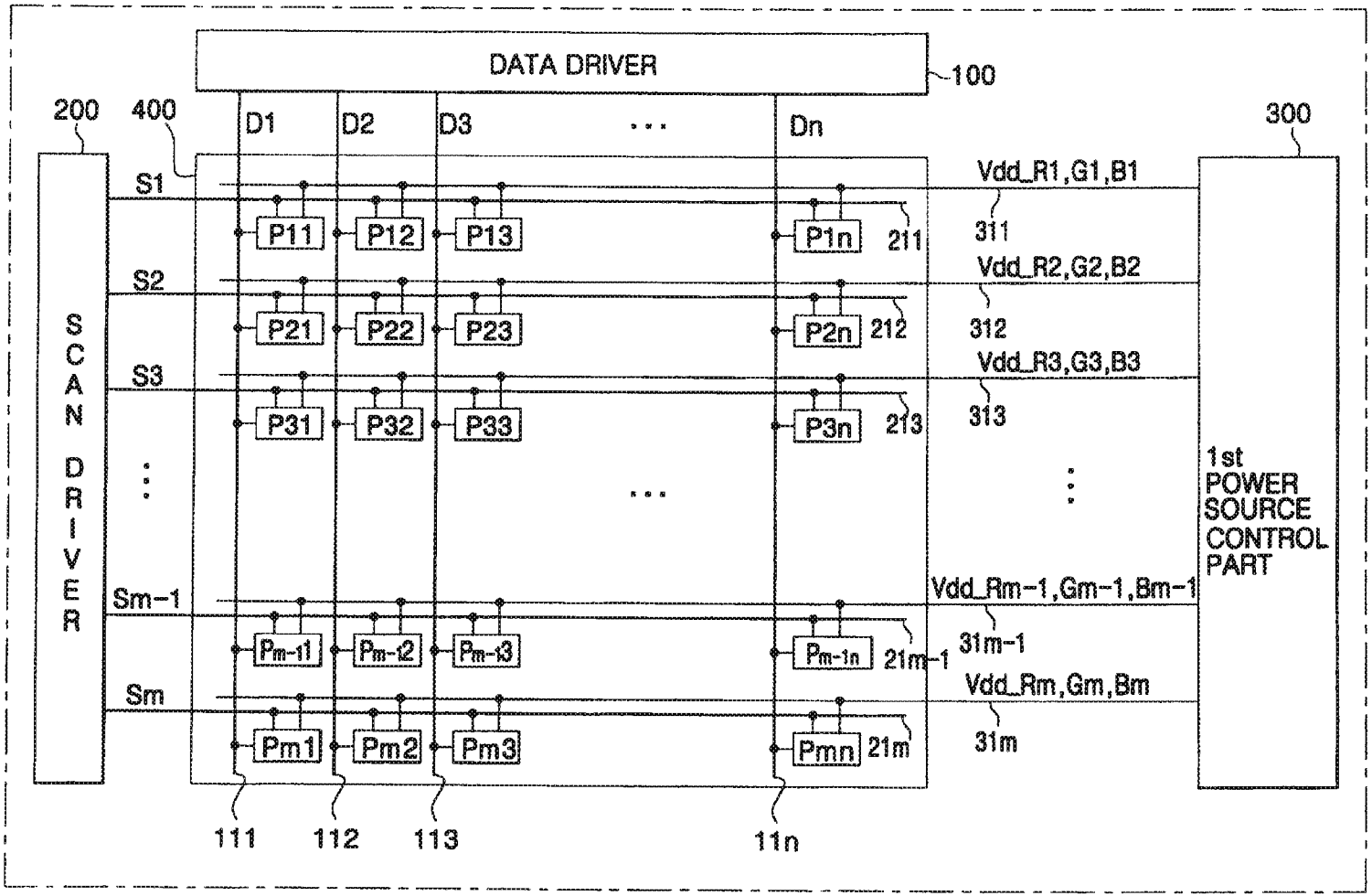
FIG. 6 is a block diagram of a pixel part in the display device of FIG. 4.

It can be seen in FIG. 6 that the pixel part 400 includes a plurality of gate lines 211-21*m* on which scan signals are transmitted from the scan driver 200, and a plurality of data lines 111-11*n* on which data signals D1-Dn are transmitted from the data driver 100. The pixel part 400 also includes a plurality of first power source lines 311-31*m* on which power source signals (Vdd_R1, G1, B1-Vdd_Rm, Gm, Bm) are respectively transmitted from the $1^{st}$ power source control part 300. A plurality of pixels P11-Pmn are respectively connected to a corresponding one of the gate lines 211-21*m*, a corresponding one of the data lines 111-11*n*, and a corresponding one of the red, green and blue first power source lines 311-31*m*.

By way of example, the pixel P11 is connected to the first gate line 211 of the plurality of gate lines 211-21*m* for providing a first scan signal S1, a first data line 111 of the plurality of data lines 111-11*n* for providing a first data signal D1, and a first power source line 311 of the plurality of first power source lines 311-31*m* for outputting first power source signals Vdd_R1, G1, B1.

Therefore, corresponding scan signals S1, S2, S3, . . . Sm and red, green and blue data signals D1-Dn are sequentially transmitted to the respective pixels P11-Pmn, respectively, through the corresponding scan and data lines. Further, the red, green and blue power source signals Vdd_R1, G1, B1-Vdd_Rm, Gm, Bm are sequentially applied to the pixels P11-Pmn through corresponding first power source lines. That is, red, green and blue EL devices R, G, B contained in each of the pixels P11-Pmn are sequentially emitted per a certain period of time in one frame in response to the first power source voltages Vdd_R1, G1, B1-Vdd_Rm, Gm, Bm that are sequentially applied, so as to display a certain color.

It can be seen in FIG. 7 that the pixel part 402 includes a plurality of gate lines 211-21*m* to which scan signals S1, S2, Sm are respectively transmitted from the scan driver 200. On a plurality of data lines D1-Dn, data signals D1, D2, . . . ,Dn are respectively transmitted from the data driver 100. On a plurality of second power source lines 511-51*m*, power source signals (Vss_R1, G1, B1-Vss_Rm, Gm, Bm) are respectively transmitted from the $2^{nd}$ power source control part 500. First power source lines 321-32*n* are used for supplying power source voltage to the pixel part 402. Each of the plurality of pixels P11-Pmn are connected to a corresponding one of the gate lines 211-21*m*, a corresponding one of the data lines 111-11*n*, a corresponding one of the first power source lines 321-32*n*, and a corresponding one of the red, green and blue second power source lines 511-51*m*.

By way of example, the first pixel P11 is connected to the first gate line 211, the first data line 111, the first power source line 321, and the second power source line 511 for outputting second power source signal Vss_R1, G1, B1.

Therefore, corresponding scan signals are applied to the respective pixels P11-Pmn through the scan lines 211 to 21*m*, and corresponding red, green and blue data signals are sequentially transmitted to the pixels P11-Pmn through the data lines 111-11*n*. Further, corresponding first power source voltages Vdd1-Vddn are applied to the pixels through the first power source lines 321-32*n*, and corresponding red, green and blue power source signals Vss_R1, G1, B1-Vss_Rm, Gm, Bm are sequentially applied to the pixels through the second power source lines 511-51*m*. Whenever corresponding scan signals S1, S2, S3, . . . Sm are applied to the respective pixels P11-Pmn, corresponding red, green and blue data signals D1-Dn are sequentially applied to the pixels P11-Pmn, and the pixels P11-Pmn sequentially emit lights corresponding to the red, green and blue data signals D1-Dn according to red, green and blue power source signals Vss_R1, G1, B1-Vss_Rm, Gm, Bm so as to display a certain color during one frame.

Figure 8:
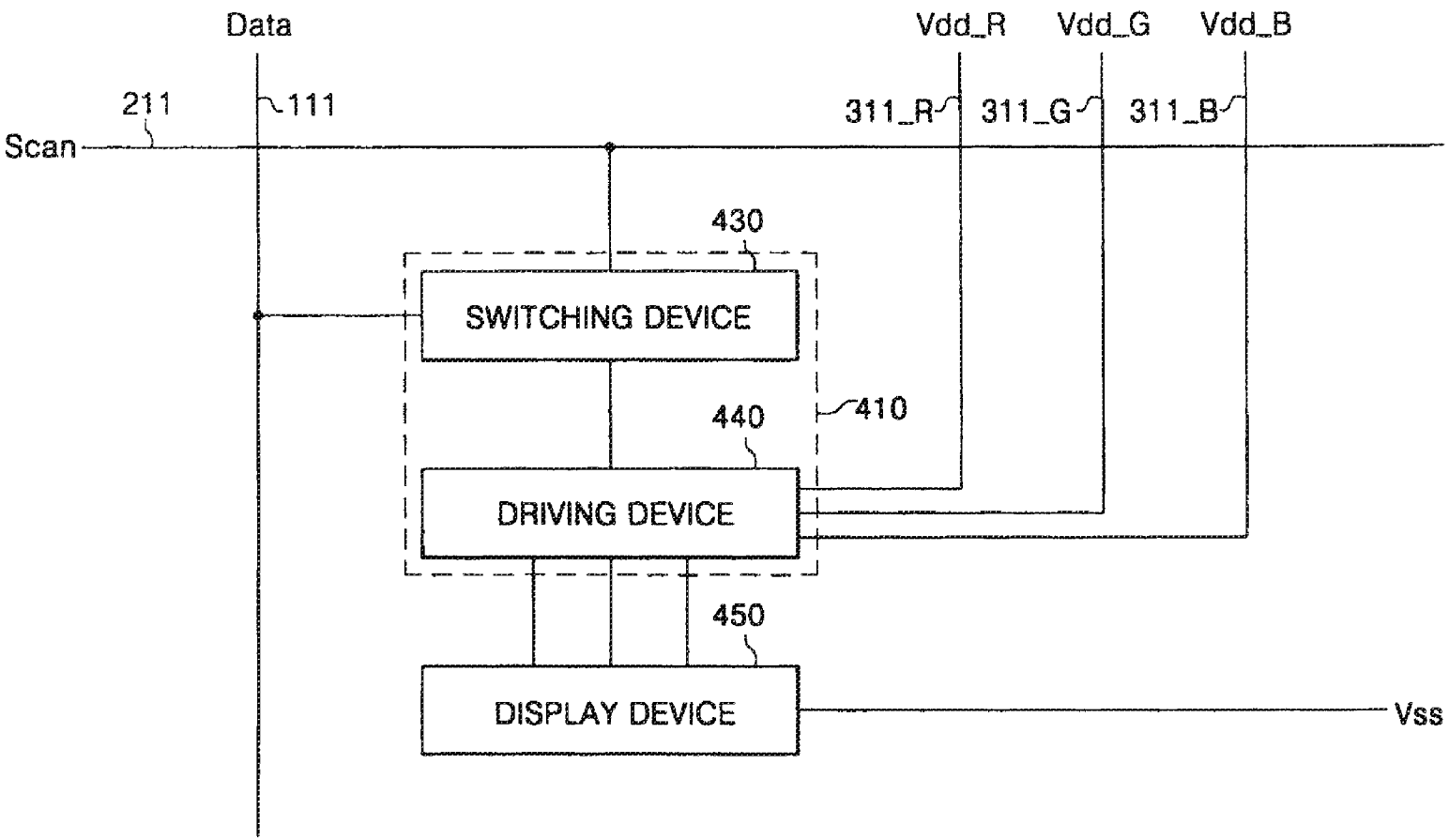
FIG. 8 is a block diagram of a pixel circuit in the pixel part of FIGS. 4 and 6.

As illustrated in FIG. 8, a pixel circuit according to the first exemplary embodiment of the present invention includes a first gate line 211 and a first data line 111. The pixel circuit also includes an active element 410 connected to the first power source line 311 including a red first power source line 311_R, a green first power source line 311_G and a blue first power source line 311_B; and a display device 450 including red, green and blue EL devices R, G, B commonly connected to the active element 410. The active device 410 includes a switching device 430 connected to the gate line 211 and the data line 111, and a driving device 440 connected to the switching device 430 and the display device 450.

In the foregoing pixel circuit of the first exemplary embodiment of the present invention, the red, green and blue EL devices R, G, B are each connected to the active device 410, and are sequentially driven during one frame. A frame in the first exemplary embodiment of the present invention is divided into a first sub frame in which the red EL device R is emitted, a second sub frame in which the green EL device G is emitted, and a third sub frame in which the blue EL device B is emitted.

Describing it in detail, a scan signal S1 is applied to the switching device 430 through the gate line 211 in the first sub frame to switch on the switching device 430 so that the data signal transmitted from the data line 111 is transmitted to the driving device 440. That is, if red data D1(DR1-DRn) and a red first power source voltage Vdd_R1 are applied to the driving device 440 through the data line 111 and a red first power source line 311_R, respectively, the driving device 440 emits the red EL device R during the first sub frame in response to the red data D1(DR1-DRn) applied to the driving device 440, and green and blue EL devices G, B are switched off during the first sub frame.

In addition, the switching device 430 is switched on by the scan signal S1 in the second sub frame so that green data D1(DG1-DGn) transmitted from the data line is transmitted to the driving device 440. If the green data D1(DG1-DGn) and a green first power source voltage Vdd_G are transmitted to the driving device 440, the green EL device G is emitted during the second sub frame in response to the green data D1(DG1-DGn) applied to the driving device 440 and switches off the red and blue EL devices R, B.

The switching device 430 is switched on through the gate line 211 in the third sub frame so that blue data D1(DB1-DBn) transmitted from the data line 111 is transmitted to the driving device 440, and if the blue data D1(DB1-DBn) and a blue first power device voltage Vdd_B1 from the blue power source line 311_B are transmitted to the driving device 440, the blue EL device B is emitted in response to the blue data D1(DB1-DBn). A certain image is displayed by sequentially driving the red, green and blue EL devices R, G, B time-divisionally during one frame so that the pixel P11 emits light having a certain color.

Although a display device 450 including red, green and blue EL devices R, G, B is described in reference to the foregoing exemplary embodiments of the present invention, the present invention is not limited to the display device 450. Instead, the present invention may be applied to other suitable display devices, such as field emission display (FED), plasma display panel (PDP), etc. Further, in other embodiments, a white EL device may be included in addition to the red, green and blue EL devices R, G, B.

Figure 10A:
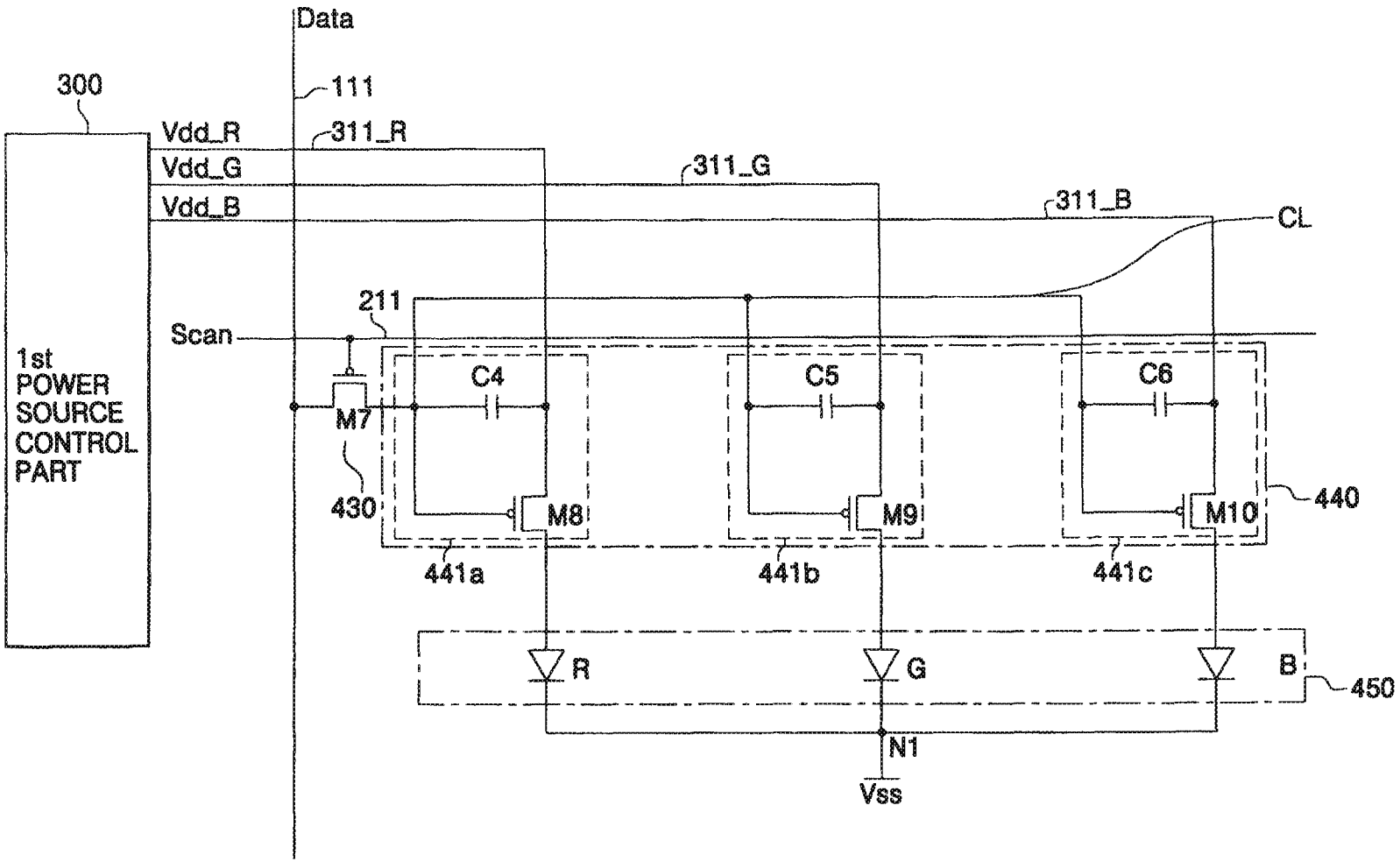
FIG. 10A is a detailed schematic diagram for the pixel circuit of FIG. 8.

Referring now to FIG. 10A, the pixel circuit of FIG. 8 is described in detail. The pixel circuit includes one gate line 211 and one data line 111, and a display device 450 including red, green and blue EL devices R, G, B coupled to three first power source lines 311_R, 311_G, 311_B, respectively. The pixel circuit also includes a $1^{st}$ power source control part 300 for sequentially applying first power source voltages Vdd_R, Vdd_G, Vdd_B, respectively, to the first power source lines 311_R, 311_G, 311_B. Further, the pixel circuit includes a switching thin film transistor M7 430 having a gate to which the gate line 211 is connected, a source to which the data line 111 is connected, and a drain connected to a common line (CL) to which the driving device 440 is commonly connected so that the driving device 440 is driven by the switching device 430.

As illustrated in FIG. 10A, the driving device 440 includes first, second and third driving devices 441*a*, 441*b*, 441*c*. The red first power source line 311_R and the red EL device R are connected to the first driving device 441*a*. The green first power source line 311_G and the green EL device G are connected to the second driving device 441*b*. The blue first power source line 311_B and the blue EL device B are connected to the third driving device 441*c*.

The switching thin film transistor M7 switches data signal in response to the scan signal S1. The first to third driving devices 441*a*, 441*b*, 441*c* apply driving currents to red, green and blue EL devices R, G, B, respectively. The red EL device R emits red light, the green EL device G emits green light, and blue EL device B emits blue light. Additionally, the red first power source line 311_R supplies a power source voltage to the red EL device R, the green first power source line 311_G supplies a power source voltage to the green EL device G, and the blue first power source line 311_B supplies a power source voltage to the blue EL device B.

As illustrated in FIG. 10A, the switching thin film transistor M7 includes a gate to which the gate line 211 is connected, a source to which the data line 111 is connected, and a drain connected to a common line (CL) to which the respective driving devices 441*a*, 441*b*, 441*c* are connected. The driving device 440 includes capacitors C4, C5, C6 coupled between the drain of the switching thin film transistor M7 and the respective sources of driving thin film transistors M8, M9 and M10. The driving thin film transistors M8, M9, M10 are connected to the capacitors C4, C5, C6, respectively, such that a gate of each of the driving thin film transistors M8, M9 and M10 is coupled to the drain of the switching thin film transistor M7. Sources of the driving thin film transistors M8, M9, M10 are connected to power source lines 311_R, 311_G, 311_B, respectively, and the drains are connected to the EL devices R, G, B, respectively. The EL devices R, G, B are connected to a first node N1 at the cathode side, and the first node N1 is connected to a second power source voltage Vss.

A display device according to the foregoing first exemplary embodiment of the present invention may further include a threshold voltage compensation device (not illustrated in drawings) for compensating a threshold voltage of the driving transistors included in the driving devices 441*a*, 441*b*, 441*c*.

Figure 10B:
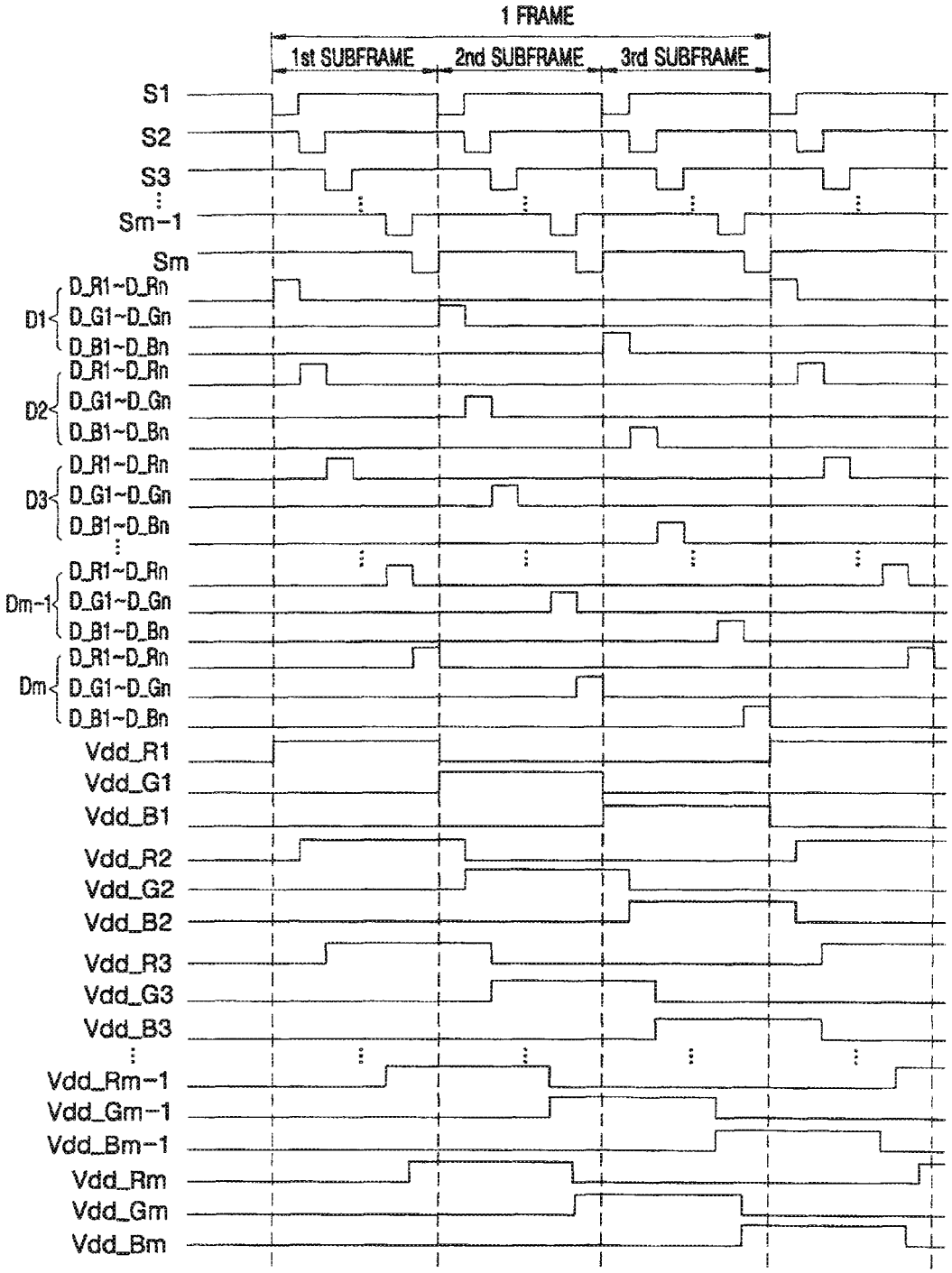
FIG. 10B is a timing diagram for the pixel circuit of FIG. 10A.

In a display device according to the first exemplary embodiment of the present invention, an emission of the EL devices R, G, B is controlled by commonly connecting respective driving thin film transistors M8, M9, M10 to one switching thin film transistor M7, and sequentially driving power source voltages Vdd_R, G, B connected to respective EL devices R, G, B. The operation of the display device is described using the timing diagram of FIG. 10B.

Conventionally, one of scan signals S1-Sm is sequentially applied to a plurality of gate lines from the scan driver 20 so that m scan signals are applied to the gate lines during one frame, and whenever respective scan signals S1-Sm are applied to the gate lines, corresponding red, green and blue data signals D1(DR1-DRn), D1(DG1-DGn), D1(DB1-DBn)-Dm(DR1-DRn), Dm(DG1-DGn), Dm(DB1-DBn), respectively, are simultaneously applied to the red, green and blue data lines 111-11*n* from the data driver 100 to drive the pixels.

On the other hand, one frame is divided into three sub frames so that 3m scan signals are applied to the gate lines during one frame in the first exemplary embodiment of the present invention. If the scan signal S1 is applied to the gate lines during a first sub frame, the switching thin film transistor M1 is switched on so that the red data signal D1(DR1-DRn) is transmitted to the driving thin film transistors M8, M9, M10 from the data lines 111-11*n*, where the 1$^{st}$ power source control part 300 applies the red power source voltage Vdd_R1 to the red first power source line 311_R and controls the green first power source voltage Vdd_G1 and the blue first power source voltage Vdd_B1 in such a way that the green first power source voltage Vdd_G1 and the blue first power source voltage Vdd_B1 are switched off. The red power source voltage Vdd_R1 is outputted as an emission signal, and the green first power source voltage Vdd_G1 and the blue first power source voltage Vdd_B1 output off signals.

Therefore, electric potential is formed between the gate and the source of the first driving thin film transistor M8 so that a driving signal is outputted to the red EL device. However, electric potential is not formed between the gate and the source of the second and third driving thin film transistors M9, M10 since corresponding power source voltage is cut off in the second and third driving thin film transistors M3, M4. Therefore, the green and blue EL devices G, B are switched off during the first sub frame.

After a certain time period, the first sub frame is completed, and a second sub frame is initiated. First, the scan signal S1 is applied to the gate line 211 so that the switching thin film transistor M7 is switched on to transmit green data signal D1(DG1-DGn) to driving transistors M8, M9, M10 from the data lines 111-11*n*.

The 1$^{st}$ power source control part 300 applies a green power source voltage Vdd_G1 so that the green first power source voltage Vdd_G1 is outputted from the green first power source line 311_G and controls red and blue first power source voltages Vdd_R1, Vdd_B1 so that the red and blue first power source voltages Vdd_R1, Vdd_B1 are cut off. Therefore, the second driving thin film transistor M9 is turned on to output driving current to green EL device G, and red EL device R is turned off as the red first power source voltage Vdd_R1 is being cut off. Additionally, the blue EL device B is also turned off as the blue first power source voltage Vdd_B1 is being cut off.

Finally, if the scan signal is applied to the gate line 211-21*m* during a third sub frame, the switching thin film transistor M7 is turned on to transmit blue data signal D1(DB1-DBn) outputted from the data lines 111-11*n* to the third driving thin film transistor M10.

As the blue power source voltage is being applied from the 1$^{st}$ power source control part 300, the blue power source voltage Vdd_B1 is applied to the third driving thin film transistor M10, and the red and green first power source voltages Vdd_R1, Vdd_G1 are cut off. Therefore, the blue EL device B is turned on, and the red and green EL devices R, G are turned off.

Subsequently, if a scan signal is applied to the second gate line 212 per each sub frame of one frame, red, green and blue data signals D2(DR1-DRn), D2(DG1-DGn), D2(DB1-DBn) are sequentially applied from the data lines 111-11*n*, respectively, to the red, green and blue EL devices of pixels P21-P2*n* connected to second gate line 212 as described above. If power source voltages sequentially are applied from the red, green and blue first power source lines 312_R, 312_G, 312_B to respective driving thin film transistors M8, M9, M10 so that the driving thin film transistors M8, M9, M10 are sequentially turned on, driving currents corresponding to the red, green and blue data signals D2(DR1-DRn), D2(DG1-DGn), D2(DB1-DBn) are sequentially transmitted to the red, green and blue EL devices R, G, B so that the red, green and blue EL devices R, G, B are driven.

If the scan signal is applied to m$^{th}$ gate line 21 m per each sub frame of one frame by repeating the foregoing actions, driving currents corresponding to the red, green and blue data signals Dm(DR1-DRn), Dm(DG1-DGn), Dm(DB1-DBn) are sequentially transmitted to the red, green and blue EL devices so that the red, green and blue EL devices are driven by sequentially applying red, green and blue data signals Dm(DR1-DRn), Dm(DG1-DGn), Dm(DB1-DBn) to data lines, and sequentially generating respective first power source voltages Vdd_Rm, Vdd_Gm, Vdd_Bm for sequentially controlling red, green and blue EL devices R, G, B of pixels Pm1-Pmn connected to the m$^{th}$ gate line 21*m* so that the driving thin film transistors M8, M9, M10 are sequentially turned on.

Therefore, one frame is divided into three sub frames in the first exemplary embodiment, and the red, green and blue EL devices R, G, B are sequentially driven during the three sub frames so that an image is displayed. The image appears as though the red, green and blue EL devices R, G, B are simultaneously driven due to fast sequential driving time even though the red, green and blue EL devices R, G, B are sequentially driven.

Therefore, a pixel driving circuit having very simple structure compared to a conventional pixel driving circuit is realized by reducing the number of components since only one gate line, one data line, one switching transistor M7 commonly connected to the red, green and blue EL devices and a driving device 440 including the driving transistors M8, M9, M10 and capacitors C4, C5, C6 are used to construct one pixel including red, green and blue EL devices R, G, B.

Further, a display device according to the present invention controls white balance by controlling emission time of red, green and blue EL devices R, G, B. That is, white balance is controlled as illustrated in FIG. 10C by controlling an application time of red, green and blue first power supply voltages Vdd_R, Vdd_G, Vdd_B, thereby controlling emission time of the red, green and blue EL devices R, G, B.

Figure 10C:
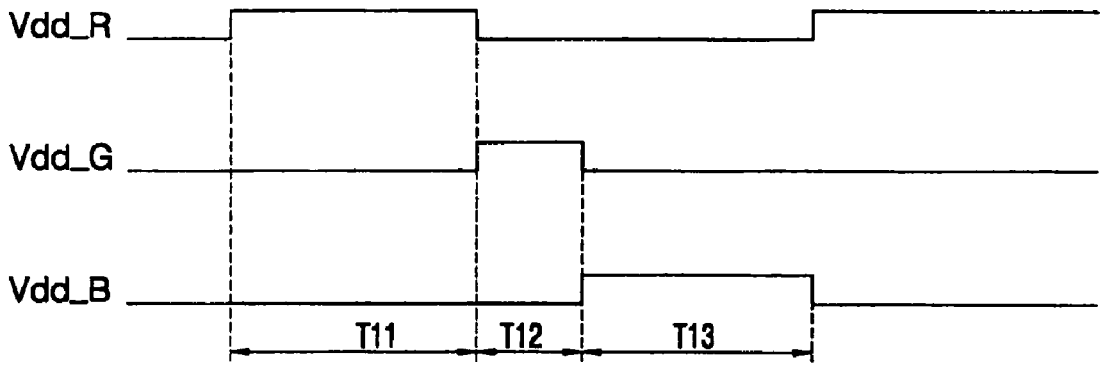
FIG. 10C is a timing diagram for white balancing in the display device of FIG. 4.

As illustrated in FIG. 10C, white balance is controlled by controlling is output periods T11, T12, T13 of red, green and blue first power source voltages Vdd_R, G, B per each sub frame, thereby controlling the emission time of the red, green and blue EL devices R, G, B.

Describing it in detail, a display device of the present invention achieves white balance by relatively lengthening turn on time T11 of the output period of the red first power source voltage Vdd_R as compared to turn on times T12, T13 of the green and blue first power source voltages Vdd_G, Vdd_B, and shortening the output period T12 of the green first power source voltage Vdd_G as compared to the output time T13 of the blue first power source voltage Vdd_B in red, green and blue first power source lines 311-31*m* in response to control of the $1^{st}$ power source control part 300.

Figure 9:
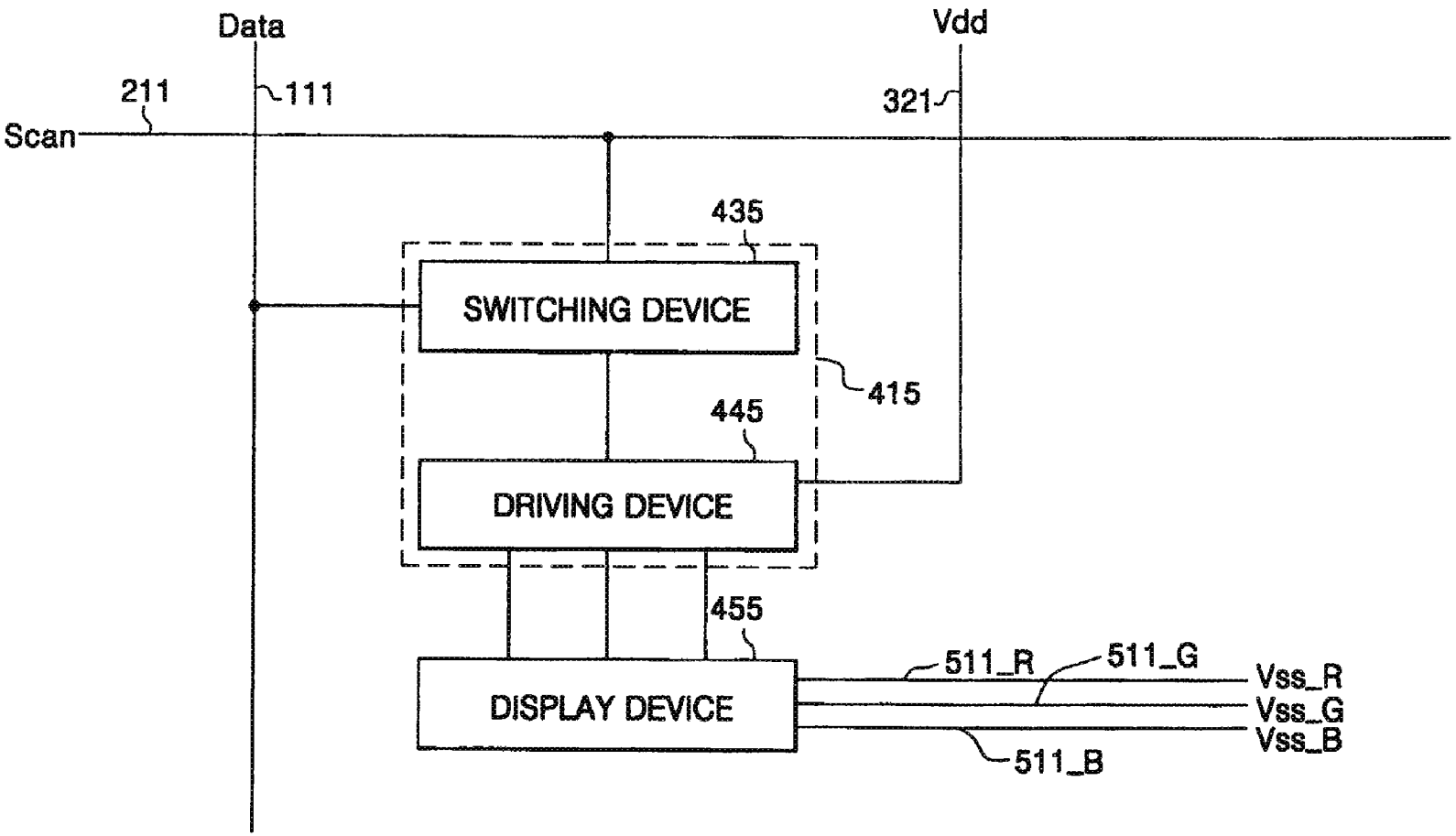
FIG. 9 is a block diagram of a pixel circuit in the pixel part of FIGS. 5 and 7.
Figure 11A:
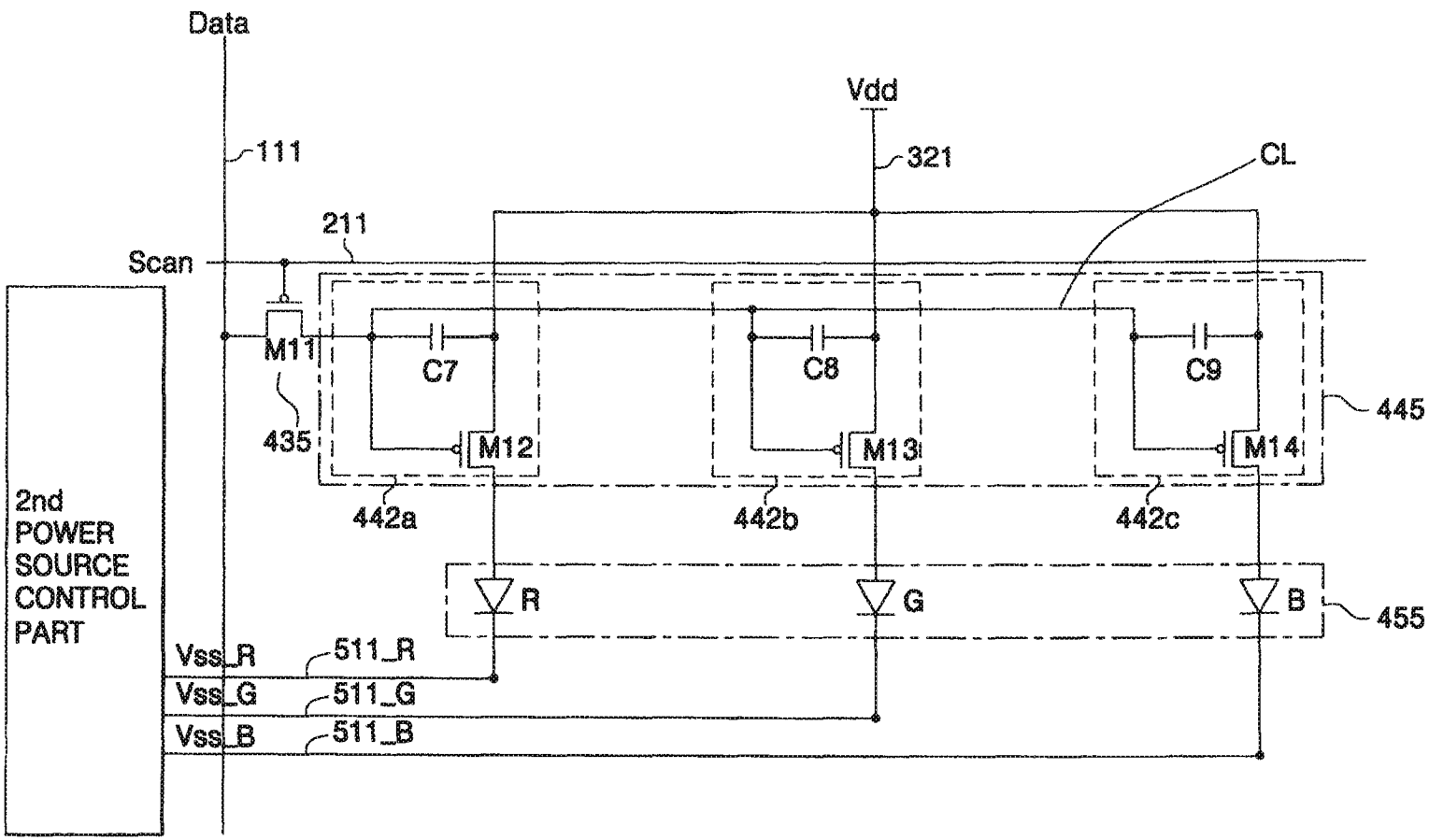
FIG. 11A is a detailed schematic diagram for the pixel circuit of FIG. 9.

As illustrated in FIG. 9 and FIG. 11A, the gate line 211, the data line 111 and a first power source line 321 are respectively connected to an active device 415. The active device 415 includes a switching device 435 and a driving device 445. The red, green and blue EL devices R, G, B 455 are commonly connected to the driving device 445 in a pixel circuit of the second exemplary embodiment of the present invention. The red, green and blue EL devices R, G, B are respectively connected to red, green and blue second power source lines 511_R, 511_G, 511_B. The switching device 435 is connected to the gate line 211 and the data line 111, respectively, and the driving device 445 is connected between the switching device 435 and the display device 455.

Therefore, if the scan signal Si is applied through the gate line 211, the switching device 435 is switched on to transmit data signals D1 through the data line 111 to the driving device 445. If the power source voltage Vdd and data signals D1(DR1-DRn) are applied to the driving device 445, the driving device 445 is switched on so as to apply driving current to the red, green and blue EL devices R, G, B. The $2^{nd}$ power source control part 500 sequentially applies a second power source voltage, that is, second power source signals Vss_R1, G1, B1 to the red, green and blue EL devices R, G, B through second power source lines 511_R, 511_G, 511_B so that the red, green and blue EL devices R, G, B are sequentially emitted during a single frame divided into three sub frames.

Describing it in detail, if the scan signal is applied to the gate line 211 in a first sub frame, and red data D1(DR1-DRn) and the power source voltage Vdd are applied to the active element 415 through the data line 111 and the power source line 321, respectively, the active element 415 outputs driving current corresponding to the red data D1(DR1-DRn) applied to the active device 415. The $2^{nd}$ power source control part 500 outputs a red power source voltage Vss_R1 to the red EL device R through the red second power source line 511_R during the first sub frame. Therefore, the red EL device R is emitted during the first sub frame, and off signals are applied to green and blue EL devices G, B through the green and blue second power source lines 511_G, 511_B so that the green and blue EL devices G, B are turned off during the first sub frame.

When the scan signal S1, green data D1(DG1-DGn) and the power source voltage Vdd are transmitted to the active device 415 in a second sub frame, the switching device 435 is switched on to transmit green data signal D1(DG1-DGn) to the driving device 445 so that the driving device outputs driving current corresponding to green data D1(DG1-DGn). Further, the $2^{nd}$ power source control part 500 outputs green power source voltage Vss_G1 to the green EL device G through the green second power source line 511_G. Therefore, the green EL device G is emitted during the second sub frame as driving signal corresponding to the green data D1(DG1-DGn) outputted from the driving device 445 is being applied to the green EL device G. In addition, the red and blue EL devices R, B are turned off during the second sub frame as off signals are being transmitted to the red and blue EL devices R, B through the second power source lines 511_R, 511_B.

When the scan signal S1 and blue data D1(DB1-DBn) are applied to the active device 415 through the gate line 211 and the data line 321, and a power source voltage is applied to the active device 415 through the power source line 321 in a third sub frame, the driving device 445 outputs a driving current corresponding to the signal of blue data D1(DB1-DBn) transmitted by the switching device 435 as described above. Further, the $2^{nd}$ power source control part 500 outputs a blue power source voltage Vss_B1 to the blue EL device B. Therefore, driving current outputted from the active device 415 is applied to the blue EL device B so that the blue EL device is emitted during the third sub frame. The red and green EL devices R, G are turned off during the third sub frame as off signals are being applied to red and green EL devices R, G from the red and green second power supply voltage lines 511_R, 511_G.

In a display device according to the second exemplary embodiment of the present invention as described above, certain colors are displayed by sequentially driving the red, green and blue EL devices R, G, B time-divisionally as the second power source voltage is sequentially being applied to the red, green and blue EL devices R, G, B.

The active device 415 includes the switching device 435 and the driving device 445. The switching device 435 and the driving device 445 include at least one switching element for driving the red, green and blue EL devices R, G, B. The switching element may include any one of a thin film transistor, a thin film diode, a diode or a triodic rectifier switch (TRS). The thin film transistor is described only as an example as those skilled in the art would appreciate.

Referring back to the detailed schematic diagram in FIG. 11A, the pixel circuit (e.g., pixel P21) includes one gate line, one data line, the display device 455 including three second power source lines 511_R, 511_G, 511_B and red, green and blue EL devices R, G, B, and the $2^{nd}$ power source control part 500 for outputting second power source voltages Vss_R1, C1, B1 to the second power source lines 511_R, 511_G, 511_B. The display device 455 may also be any other suitable display device such as FED, PDP, etc. Further, white EL device may also be used in the present invention in addition to the red, green and blue EL devices R, G, B.

The pixel circuit further includes an active device 415 for sequentially driving the display device 455 time-divisionally. The active device 415 includes the switching device 435 and the driving device 445 including first, second and third driving devices 442*a*, 442*b*, 442*c* commonly connected to the switching device 435 to output driving signals, respectively, in response to the transmitted data signal. The switching thin film transistor M11 is switched on by the scan signal S1 applied through the gate line 211 to transmit the data signal.

The first driving device 442*a* is connected to the red EL device R and the red second power source line 511_R as illustrated in FIG. 11A. The green EL device G and the green second power source line 511_G are connected to the second driving device 442*b*, and the blue EL device B and the blue second power source line 511_B are connected to the third driving device 442*c*.

Describing it in detail, the red second power source line 511_R transmits on/off signals for the red EL device R, the green second power source line 511_G transmits on/off signals for the green EL device G, and the blue second power source line 511_B transmits on/off signals for the blue EL device B. A common line (CL) is connected to the switching thin film transistor M11 and respective driving devices 442*a*, 442*b*, 442*c*.

The switching transistor M11 includes a gate to which the gate line 211 is connected, source to which the data line 111 is connected, and a drain to which the common line CL is connected. Hence, the drain is connected to the driving devices 442*a*, 442*b*, 442*c*. The driving devices 442*a*, 442*b*, 442*c* include driving thin film transistors M12, M13, M14 and capacitors C7, C8, C9, respectively. The gates of the transistors are connected through the common line CL to the drain of the switching thin film transistor M11. In addition, the capacitors C7, C8, C9 and the driving thin film transistors M12, M13, M14 are connected to the first power source line Vdd.

First, the switching thin film transistor M11 is switched on by the scan signal outputted from the scan driver 200. An image signal of the data line 111 connected to the source of the switching thin film transistor M11 is transmitted to the drain of the switching thin film transistor M11. Therefore, the image signal is transmitted to the respective driving devices 442*a*, 442*b*, 442*c* commonly connected to the switching thin film transistor M11 through the common line CL. As the image signal is transmitted to the driving devices 442*a*, 442*b*, 442*c*, the driving devices 442*a*, 442*b*, 442*c* fill the image signal in the capacitors C7, C8, C9 so that the image signal is maintained for a certain period of time even after the scan signal of the gate line 211 is turned off. The driving thin film transistors M12, M13, M14 transmit to the red, green and blue EL devices R, G, B a driving current corresponding to a square of a value obtained by subtracting the image signal and threshold voltage from the applied first power source voltage Vdd.

Further, the $2^{nd}$ power source control part 500 outputs second power source signals to the red EL device R through the red second power source line 511_R with the second power source signals being connected with output of the selection signal and image signal. Therefore, the red EL device emits red light corresponding to the driving signal outputted from the first driving device 442*a*. The $2^{nd}$ power source control part 500 applies an off signal to the green and blue EL devices G, B through the green second power source line 511_G and the blue second power source line 511_B, respectively, so that the green and blue EL devices are turned off.

After a certain time period, when the scan signal is applied to the switching thin film transistor M11 through the gate line 211, the switching thin film transistor M11 is switched on so that an image signal is applied. The red second power source line 511_R is cut off by control of the $2^{nd}$ power source control part 500. The green second power source line 511_G outputs second power source signal, and the blue second power source line 511_B is cut off so that the red EL device R and the blue EL device B are turned off while the green EL device G is emitted.

Further, after a certain time period, when the scan signal is applied to the switching thin film transistor M11 through the gate line 211 again so that the switching thin film transistor M11 is switched on to apply an image signal to the data line 111, the $2^{nd}$ power source control part 500 applies an off signal to the red and green second power source lines 511_R, 511_G, and applies an second power source signal to the blue second power source line 511_B. Therefore, the red EL device R and the green EL device G are turned off, and the blue EL device B is emitted. That is, the EL devices R, G, B inside the pixel circuit are sequentially driven time-divisionally using the second power source voltages Vss_R1, G1, B1 in a display device according to the second exemplary embodiment of the present invention.

Figure 11B:
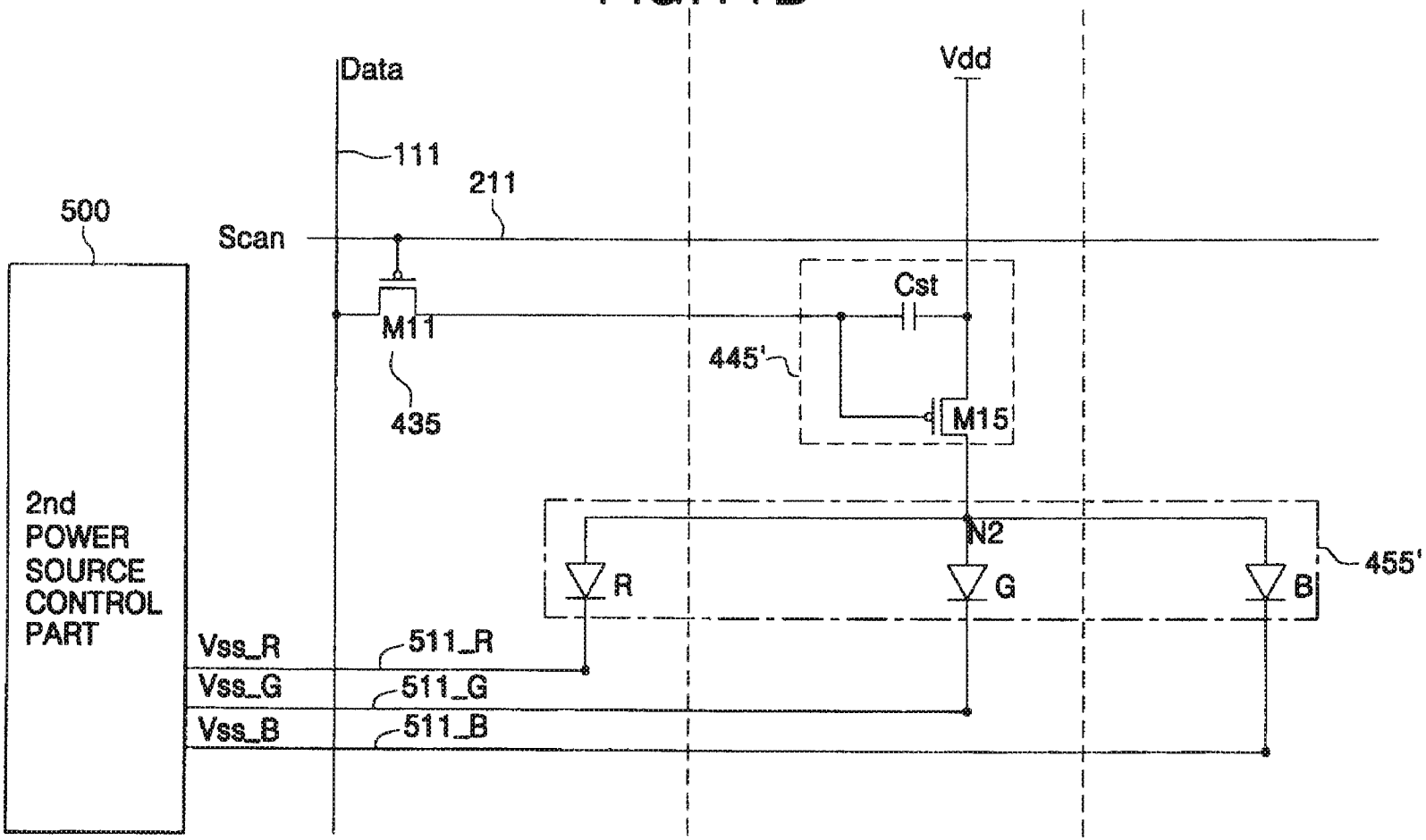
FIG. 11B is a detailed schematic diagram for a pixel circuit in a third exemplary embodiment according to the present invention.

The schematic diagram of the pixel circuit of a third exemplary embodiment shown in FIG. 11B is identical to the pixel circuit of FIG. 11A, except that the driving device 445 has been replaced by the driving device 445', and the display device 455 has been replaced by the display device 455'.

As illustrated in FIG. 11B, the driving device 445' is connected to the drain of the switching transistor M11. The driving device 445' includes a capacitor Cst and a driving thin film transistor M15. Further, a second node N2 is connected to the drain of the driving thin film transistor M15 and the anodes of the EL devices R, G, B. In addition, the second power source lines 511_R, 511_G, 511_B are connected to the cathodes of the red, green and blue EL devices R, G, B, respectively. The second power source lines 511_R, 511_G, 511_B are also connected to the $2^{nd}$ power source control part 500.

If the scan signal is applied to the switching transistor M11 through the gate line 211, the switching transistor M11 is turned on to transmit an image signal outputted from data line to the driving device 445'. Therefore, an applied image signal is stored in the capacitor Cst. Therefore, the driving device 445' transmits a driving current corresponding to the power source line 321 and image signal applied to the red, green and blue EL devices R, G, B through the second node N2. The $2^{nd}$ power source control part 500 applies an second power source signal to the red EL device R through the red second power source line 511_R so that the red EL device R is emitted, and the $2^{nd}$ power source control part 500 applies an off signal to the green and blue second power source lines 511_G, 511_B so that the green and blue EL devices are turned off.

Further, after a certain time period, the $2^{nd}$ power source control part 500 sequentially applies an off signal to the red second power source line 511_R so that the red EL device R is turned off, outputs an second power source signal to the green second power source line 511_G so that the green EL device G is emitted and outputs an off signal to the blue second power source line 511_B so that the blue EL device B is turned off.

Further, if an image signal is outputted from the data line so that a driving current is outputted from the driving device 445' after a certain time period, the $2^{nd}$ power source control part 500 sequentially transmits off signals to the red second power source line 511_R and the green second power source line 511_G so that the red EL device R and the green EL device G are turned off and outputs an second power source signal to the blue second power source line 511_B so that the blue EL device B is emitted.

A display device according to the third exemplary embodiment of the present invention includes red, green and blue EL devices R, G, B, the switching thin film transistor M11, the driving thin film transistor M15 and the capacitor Cst. The emission of the red, green and blue EL devices R, G, B is controlled by sequentially controlling driving of the second power source voltages. The display device of the third exemplary embodiment may also include a threshold voltage compensation device (not shown) for compensating threshold voltage of the driving thin film transistor M15.

Figure 11C:
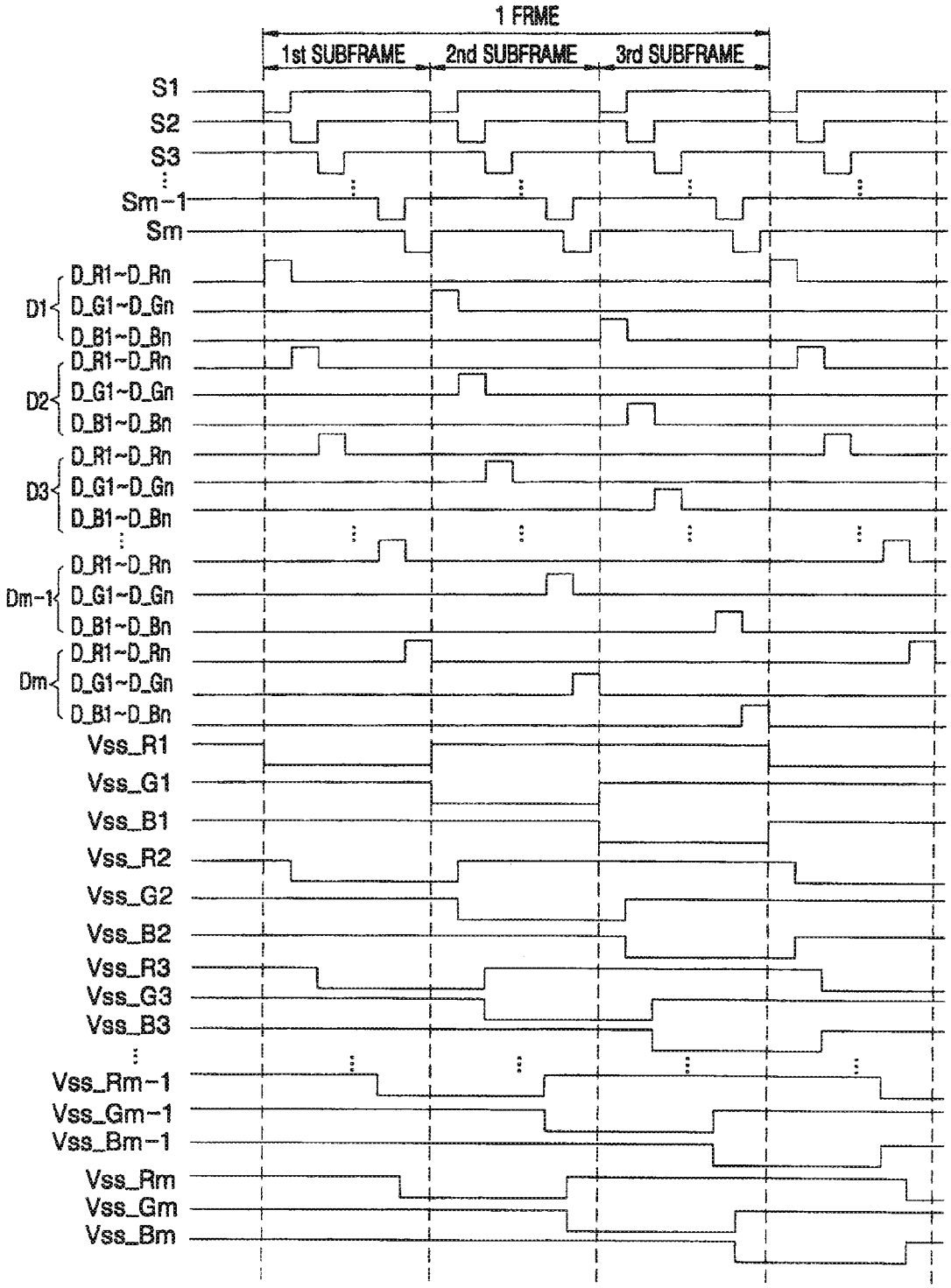
FIG. 11C is a timing diagram for the pixel circuits of FIGS. 11A and 11B.

Driving of the foregoing display devices according to the second and third exemplary embodiments of the present invention is described in detail using the timing diagram of FIG. 11C.

One frame is divided into three sub frames, and 3*m* scan signals are applied in the display devices according to the second and third exemplary embodiments of the present invention. If the scan signal S1 is applied through the gate line 211 during the first sub frame, the switching transistor Mil is turned on so that the red data signal D1(DR1-DRn) is transmitted to the driving thin film transistors M12, M13 and M14 (or M15) through the data lines 111-11*n*. The $2^{nd}$ power source control part 500 outputs the red second power source voltage Vss_R and turns off the green second power source voltage Vss_G and the blue second power source voltage Vss_B.

Therefore, the red EL device R is emitted as a driving signal is being applied to the red EL device R, and the green and blue EL devices G, B are turned off during the first sub frame as the green second power source voltage Vss_G and the blue second power source voltage Vss_B are being tuned off.

After a certain time period, the first sub frame is completed, and the second sub frame is initiated. When the scan signal S1 is applied to the gate line 211, the switching thin film transistor M11 is turned on so that the green data signal D1(DG1-DGn) is transmitted to the driving transistors M12, M13 and M14 (or M15) from the data lines 111-11*n*.

Then, the $2^{nd}$ power source control part 500 outputs the green second power source voltage Vss_G and turns off the red and blue second power source voltages Vss_R, Vss_B so that the driving signal is applied to the green EL device G, and the red and blue EL devices R, B are turned off.

Finally, when the scan signal S1 is applied to the gate line 211 during the third sub frame, the switching thin film transistor M11 is turned on to transmit the blue data signal D1(DB1-DBn) outputted from the data lines 111-11*n*.

Then, the $2^{nd}$ power source control part 500 outputs the blue second power source voltage Vss_B and turns off the red and green second power source voltages Vss_R, Vss_G so that the blue EL device B is turned on, and the red and green EL devices R, G are turned off.

Subsequently, if the scan signal is applied to the second gate line 212 per each sub frame of one frame, red, green and blue data signals D2(DR1-DRn), D2(DG1-DGn), D2(DB1-DBn) are sequentially applied to the red, green and blue EL devices R, G, B of pixels P21-P2*n* connected to the second gate line 212 from the data line D2 as described above. If red, green and blue second power source voltages Vss_R, Vss_G, Vss_B are sequentially applied, driving currents corresponding to the red, green and blue data signals D2(DR1-DRn), D2(DG1-DGn), D2(DB1-DBn) are sequentially applied to red, green and blue EL devices R, G, B so that the red, green and blue EL devices R, G, B are driven.

Therefore, one frame is divided into three sub frames, and the red, green and blue EL devices are sequentially driven during the three sub frames so that an image is displayed. The image appears as though the red, green and blue EL devices are displayed in one color by promptly controlling sequential driving time of the respective second power source voltages Vss_R, Vss_G, Vss_B, thereby giving an appearance that the red, green and blue EL devices are being driven at the same time although red, green and blue EL devices R, G, B are sequentially driven.

Although it is described as one example that certain colors are realized by dividing one frame into three sub frames so that the red, green and blue EL devices R, G, B are sequentially driven in the foregoing first, second and third exemplary embodiments of the present invention, the light emitting elements may be sequentially driven using faster switching action of the active element.

Further, although a display device in which light emitting elements are driven by dividing one frame into three sub frames is described as one example in the foregoing first, second and third exemplary embodiments of the present invention, the sub frames are not limited to the three sub frames only.

That is, in order to adjust display characteristics such as chromaticity, brightness or luminance, etc. in the present invention, the light emitting is elements may be emitted in colors of red, red, green and blue or colors of red, green, green and blue, etc. by dividing one frame into more than three sub frames, e.g., four sub frames, and/or the light emitting elements may be sequentially driven time-divisionally by dividing one frame into four or more sub frames.

In addition, in order to adjust the foregoing display characteristics, white EL device may be added to the red, green and blue EL devices so that one or at least two EL devices in the red, green, blue and white EL devices are driven during one frame by separately driving four or more sub frames during one frame. At least two EL devices in the red, green, blue and white EL devices may be sequentially driven time-divisionally during one frame by dividing one frame into a plurality of sub frames.

Further, an organic electroluminescent display device is capable of controlling white balance by controlling emission time of red, green and blue EL devices. The white balance is controlled as illustrated in FIG. 11D, for example, by controlling output time of red, green and blue second power source voltages Vss_R, Vss_G, Vss_B, thereby controlling emission time of the red, green and blue EL devices.

Figure 11D:
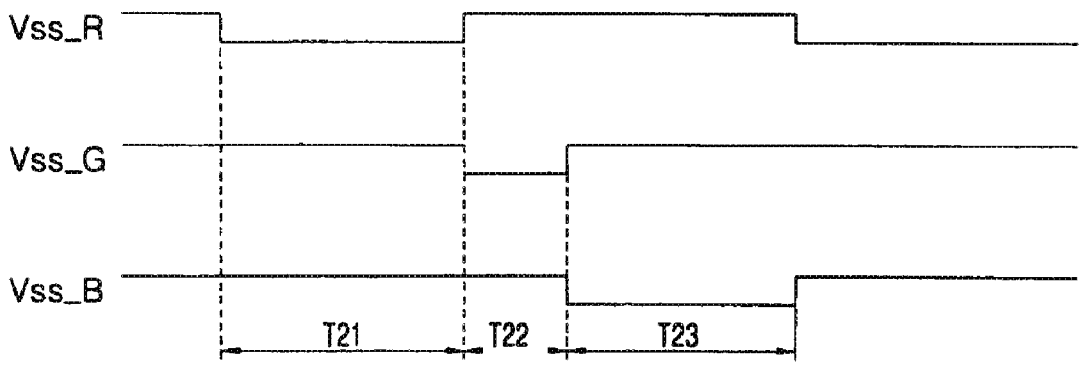
FIG. 11D is a timing diagram for showing white balancing in the display device of FIG. 5 for the pixel circuits in FIGS. 11A and 11B.

That is, the driving thin film transistors M2, M3, M4 of each unit pixel are turned on by controlling output times T21, T22, T23 of the red, green and blue second power source voltages per each sub frame so that the white balance is controlled by emission time of the red, green and blue EL devices as illustrated in FIG. 11D.

Describing it in detail, in a display device in the second and third is exemplary embodiments of the present invention, white balance may be realized by relatively lengthening turn on time T21 of the red second power source voltage Vss_R out of the red, green and blue second power source voltages Vss_R, Vss_G, Vss_B compared to turn on times T22, T23 of the green and blue second power source voltages Vss_G, Vss_B and shortening output time T22 of the green second power source voltage Vss_G compared to output time T23 of the blue second power source voltage Vss_B, thereby controlling emission time of the respective red, green and blue EL devices.

As described above, a pixel driving circuit for an organic electroluminescent display device and a driving method of the organic electroluminescent display device according to the present invention not only improve opening ratio of light emitting elements due to reduction of the number of elements and wirings, but also reduce voltage drop and RC delay between respective pixels by sequentially driving each organic EL device using a switching device and/or a driving device commonly so that pixels are displayed.

While the present invention has been particularly shown and described with reference to certain exemplary embodiments thereof, it will be understood by those skilled in the art that the foregoing and other changes in form and details may be made therein without departing from the spirit or scope of the present invention as embodied in the appended claims and equivalents thereof.

What is claimed is:

1. A pixel driving circuit for a display device in which a plurality of gate lines and data lines are arranged, the pixel driving circuit being disposed at an intersection between the gate lines and the data lines, the pixel driving circuit comprising;

at least two light emitting elements for emitting certain colors within a period of time;

a switching device for transmitting data signals received through one of the data lines in response to scan signals received through one of the gate lines;

a driving device connected to the at least two light emitting elements to sequentially transmit driving signals to the at least two light emitting elements in response to the data signals transmitted by the switching device; and a power source control part connected to the at least two light emitting elements to sequentially transmit power source signals, wherein the at least two light emitting elements are sequentially emitted per a sub-period of time in the period of time in response to the power source signals to realize the certain colors in the period of time.

2. The pixel driving circuit for a display device according to claim 1, wherein the power source control part is a second power source part for sequentially transmitting a second power source voltage to the at least two light emitting elements, and as the second power source voltage is sequentially transmitted to the at least two light emitting elements per the sub-period of time in the period of time, the at least two light emitting elements are sequentially driven time-divisionally.

3. The pixel driving circuit for a display device according to claim 2, wherein the period of time is one frame, the one frame is divided into at least two sub frames, the sub-period of time is one said sub frame, and the at least two light emitting elements are sequentially driven per sub frame inside the one frame.

4. The pixel driving circuit for a display device according to claim 2, wherein the period of time is one frame, the one frame is divided into at least three sub frames, the sub-period of time is one said sub frame, the at least two light emitting elements are sequentially driven per sub frame inside the one frame, and one said light emitting element is driven again or the at least two light emitting elements are substantially simultaneously driven in remaining at least one sub frame so that brightness is controlled.

5. The pixel driving circuit for a display device according to claim 3, wherein the remaining at least one sub frame is arbitrarily selected from the at least three sub frames.

6. The pixel driving circuit of display device according to claim 1, wherein a light emitting time of the at least two light emitting elements is controlled by the power source signals so that the at least two light emitting elements are sequentially driven to control white balance.

7. The pixel driving circuit for a display device according to claim 1, wherein the at least two light emitting elements include at least one of a red EL device, a green EL device, a blue EL device and a white EL device.

8. The pixel driving circuit for a display device according to claim 1, wherein the at least two light emitting elements include a first electrode commonly connected to the driving device, and a second electrode connected to the power source control part.

9. The pixel driving circuit for a display device according to claim 1, wherein the switching device and the driving device include at least one switching element, which is a thin film transistor, a thin film diode, a diode or a triodic rectifier switch (TRS).

10. A pixel driving circuit for a display device comprising:

red, green and blue EL devices, each having a first electrode and a second electrode;

a switching transistor for sequentially transmitting red, green and blue data signals; and a plurality of driving devices connected to the switching transistor to drive the red, green and blue EL devices in response to the red, green and blue data signals sequentially received through the switching transistor, wherein each said first electrode is connected to a corresponding one of the plurality of driving devices, and each said second electrode is connected to a second power source control part, such that the red, green and blue EL devices are sequentially emitted in response to driving signals transmitted by the driving devices in response to second power source signals transmitted from the second power source control part.

11. The pixel driving circuit for a display device according to claim 10, wherein the plurality of driving devices are commonly connected to a power source.

12. The pixel driving circuit for a display device according to claim 11, wherein each said driving device comprises a driving transistor connected to a second electrode of the switching transistor; and a capacitor connected between a gate of the driving transistor and the power source.

13. The pixel driving circuit for a display device according to claim 10, wherein the pixel driving circuit further comprises a threshold voltage compensation device for compensating deviation of a threshold voltage.

14. The pixel driving circuit for a display device according to claim 10, wherein the second power source signals include a second power source voltage for controlling emission of the red, green and blue EL devices by sequentially outputting the second power source voltage to the red, green and blue EL devices.

15. The pixel driving circuit for a display device according to claim 10, wherein the red, green and blue EL devices are sequentially driven in response to the second power source signals per each sub frame inside the one frame including at least three sub frames.

16. The pixel driving circuit for a display device according to claim 15, wherein the red, green and blue EL devices are sequentially driven in three sub frames, the red, green and blue EL devices are independently driven in a remaining sub frame, or at least two said EL devices are driven in the remaining sub frame.

17. The pixel driving circuit for a display device according to claim 10, wherein the red, green and blue EL devices control white balance by controlling a light emitting time using corresponding ones of the second power source signals in respective sub frames.

18. A pixel driving circuit for a display device comprising:

red, green and blue EL devices, each having a first electrode and a second electrode;

a switching transistor for sequentially transmitting red, green and blue data signals;

a driving transistor connected to the switching transistor to sequentially drive the red, green and blue EL devices in response to the red, green and blue data signals; and storage means for storing the red, green and blue data signals, wherein the first electrodes of the EL devices are commonly connected to the driving transistor, and each said second electrode is connected to a second power source control part, such that the red, green and blue EL devices are sequentially emitted in response to the driving signals transmitted through the driving transistors in response to second power source signals received from the second power source control part.

19. A pixel driving circuit for a display device according to claim 18, wherein the second power source signals comprise separate second power source signals for controlling emission of the red, green and blue EL devices by sequentially outputting the corresponding second power source signals to the red, green and blue EL devices, respectively.

20. The pixel driving circuit for a display device according to claim 18, wherein the pixel driving circuit further comprises a threshold voltage compensation device for compensating deviation of a threshold voltage.

21. The pixel driving circuit for a display device according to claim 18, wherein the red, green and blue EL devices are sequentially driven in response to the second power source signals per each sub frame inside one frame including at least three sub frames.

22. The pixel driving circuit for a display device according to claim 21, wherein the red, green and blue EL devices are sequentially driven in three sub frames, the red, green and blue EL devices are independently driven in a remaining sub frame, or at least two EL devices are driven in the remaining sub frame.

23. The pixel driving circuit for a display device according to claim 22, wherein the red, green and blue EL devices control white balance by controlling a light emitting time using the second power source signals in the respective sub frames.

24. An organic electroluminescent display device comprising a pixel driving circuit disposed at an intersection between gate lines and data lines, the pixel driving circuit comprising:

a first transistor having a gate connected to one of the gate lines, and a source connected to one of the data lines;

a second transistor having a gate coupled to a drain of the first transistor;

a first capacitor connected between the gate and the source of the second transistor;

a third transistor having a gate coupled to the drain of the first transistor;

a second capacitor connected between the gate and the source of the third transistor;

a fourth transistor having a gate coupled to the drain of the first transistor;

a third capacitor connected between the gate and the source of the fourth transistor;

a first power source line commonly connected to sources of the second, third and fourth transistors;

red, green and blue EL devices, each having a first electrode connected to the drain of a corresponding one of the second, third and fourth transistors;

a red second power source line connected to a second electrode of the red EL device;

a green second power source line connected to a second electrode of the green EL device; and a blue second power source line connected to a second electrode of the blue EL device.

25. The organic electroluminescent display device according to claim 24, wherein the organic electroluminescent display device further comprises a second power source control part for sequentially driving red, green and blue second power source voltages in the red, green and blue second power source lines, respectively.

26. An organic electroluminescent display device comprising a pixel driving circuit disposed at an intersection between gate lines and data lines, the pixel driving circuit comprising:

a first transistor having a gate connected to one of the gate lines, and a source connected to one of the data lines;

a second transistor having a gate connected to a drain of the first transistor, and a source connected to a power source line;

a capacitor connected between the gate of the second transistor and the power source line;

red, green and blue EL devices, each having a first electrode connected to the drain of the second transistor;

a red second power source line connected to a second electrode of the red EL device;

a green second power source line connected to a second electrode of the green EL device; and a blue second power source line connected to a second electrode of the blue EL device.

27. The organic electroluminescent display device according to claim 26, wherein the organic electroluminescent display device further comprises a second power source control part for sequentially driving red, green and blue second power source voltages in the red, green and blue second power source lines, respectively.

28. A driving method for a display device comprising a plurality of gate lines, a plurality of data lines, a plurality of power source lines, a plurality of second power source lines, and a plurality of pixels, each pixel being connected to a corresponding one of the gate lines, a corresponding one of the data lines, a corresponding one of the power source lines, and a corresponding one of the second power source lines, each pixel comprising at least red, green and blue light emitting elements, the method comprising:

generating scan signals per a sub-period of time in a period of time to the corresponding one of the gate lines;

sequentially applying red, green and blue data to the corresponding one of the data lines whenever the scan signals are generated so that red, green and blue driving signals are generated to the corresponding one of the data lines; and sequentially driving the at least red, green and blue light emitting elements of the pixel connected to the corresponding one of the gate lines using second power source signals sequentially applied from a second power source control part, thereby realizing a certain color for the sub-period of time in the period of time.

29. The driving method for a display device according to claim 28, wherein the sub-period of time includes three sections, and the at least red, green and blue light emitting elements are emitted one by one during the three sections so that the at least red, green and blue light emitting elements are sequentially emitted during the sub-period of time.

* * * * *

UNITED STATES PATENT AND TRADEMARK OFFICE

CERTIFICATE OF CORRECTION

PATENT NO. : 8,274,455 B2
APPLICATION NO. : 12/873240
DATED : September 25, 2012
INVENTOR(S) : Won-Kyu Kwak et al.

It is certified that error appears in the above-identified patent and that said Letters Patent is hereby corrected as shown below:

On the Title Page

| | |
|---|---|
| Item (56) References Cited FOREIGN PATENT DOCUMENTS, page 2, right column, line 7 | Delete "JP 2001-0105273"<br>Insert -- KR 2001-0105273 -- |
| Item (56) References Cited FOREIGN PATENT DOCUMENTS, page 2, right column, line 9 | Delete "JP 2002-0060604"<br>Insert -- KR 2002-0060604 -- |

Signed and Sealed this
Fourth Day of March, 2014

Michelle K. Lee

Michelle K. Lee
*Deputy Director of the United States Patent and Trademark Office*